US006223669B1

(12) United States Patent
Bowden

(10) Patent No.: US 6,223,669 B1
(45) Date of Patent: May 1, 2001

(54) VESSEL HAVING A STANDARDIZED HULL CAPABLE OF HAVING A PLURALITY OF OPTIONAL AND OPERATIONAL MODULAR STRUCTURES AND METHOD OF CONSTRUCTION THEREFOR

(75) Inventor: John Ontee Bowden, Pascagoula, MS (US)

(73) Assignee: Ingalls Shipbuilding, Inc., Pascagoula, MI (US)

( * ) Notice: Subject to any disclaimer, the term of this patent is extended or adjusted under 35 U.S.C. 154(b) by 0 days.

(21) Appl. No.: 09/100,127

(22) Filed: Jun. 19, 1998

(51) Int. Cl.[7] ..... B63B 3/00
(52) U.S. Cl. ..... 114/65 R; 114/72; 114/77 R
(58) Field of Search ..... 114/65 R, 71, 114/72, 77 A, 77 R, 259–261; 414/139.4, 139.7, 140.6, 143.2

(56) References Cited

U.S. PATENT DOCUMENTS 2,141,181 * 12/1938 Geddes ..... 114/71
3,138,131 * 6/1964 Szychlinski ..... 114/72
3,602,730 * 8/1971 Cushing ..... 114/72
3,785,316 * 1/1974 Leming et al. ..... 114/261
4,476,798 * 10/1984 Backus ..... 114/77 R
4,715,308 * 12/1987 Denison et al. ..... 114/72
4,732,103 * 3/1988 Culbertson ..... 114/65 R
5,924,377 * 7/1999 Rausch et al. ..... 114/71

FOREIGN PATENT DOCUMENTS

1573981 * 7/1969 (FR) ..... 114/72

* cited by examiner

*Primary Examiner*—Ed Swinehart
(74) *Attorney, Agent, or Firm*—Lowe Hauptman Gilman & Berner, LLP

(57) ABSTRACT

A vessel capable of having a plurality of the following structures and method of construction therefor are disclosed. The vessel comprises a hull including a cavity for receiving a plurality of containers. The vessel has one or more of the following features: a bow ramp with clamshell doors; side-port doors and ramps; internal overhead container handling system with transverse jib booms; container compartment; exterior rolling container crane with jib booms; forward pallet elevators; aft pallet elevators; a helicopter hangar; a cargo/helicopter elevator; a stern ramp/gate; a wet/dry well deck; RO/RO cargo decks; a helicopter flight deck; a wet-well ballast system; and a bow-grounding ballast system.

21 Claims, 28 Drawing Sheets

Arrangements - Inboard Profile

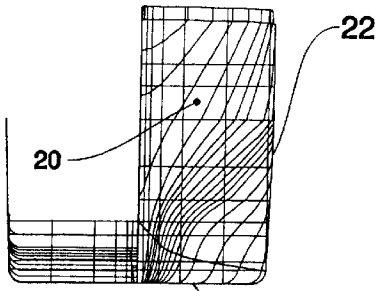
Figure 1c: Hull Lines Drawing
Body Plan
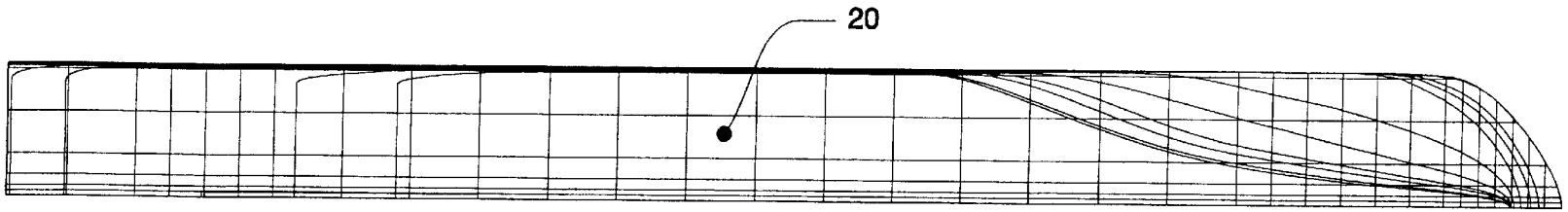
Figure 1b: Hull Lines Drawing
Waterlines
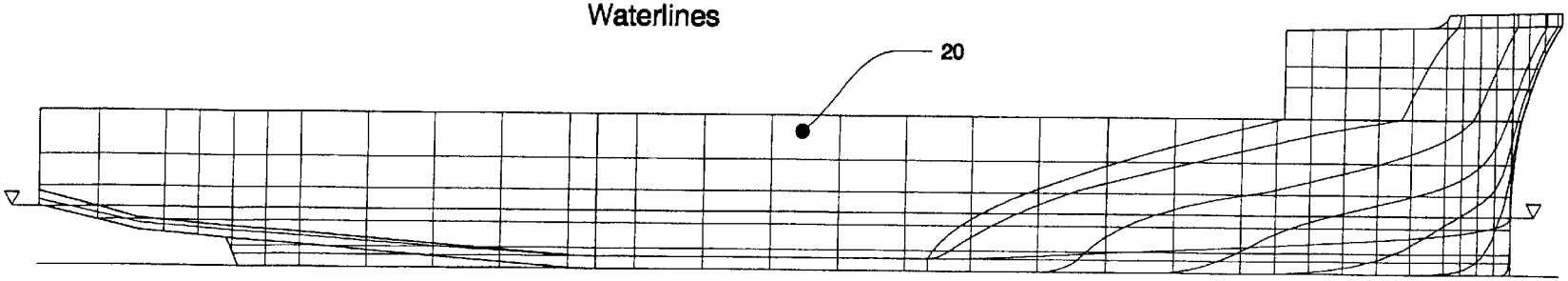
Figure 1a: Hull Lines Drawing
Buttock Plan

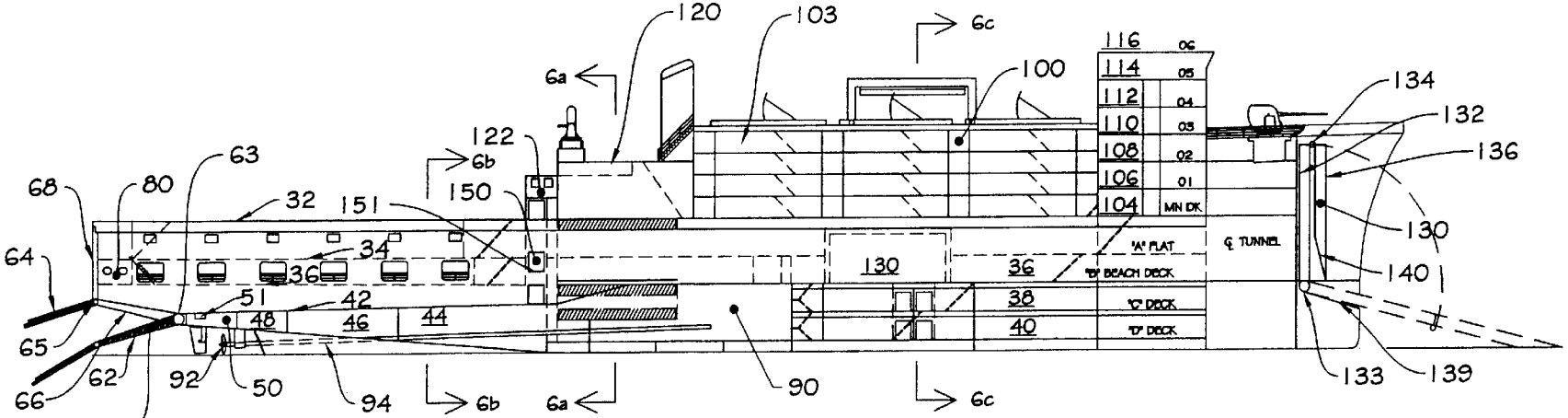
Fig. 2b: Arrangements - Inboard Profile
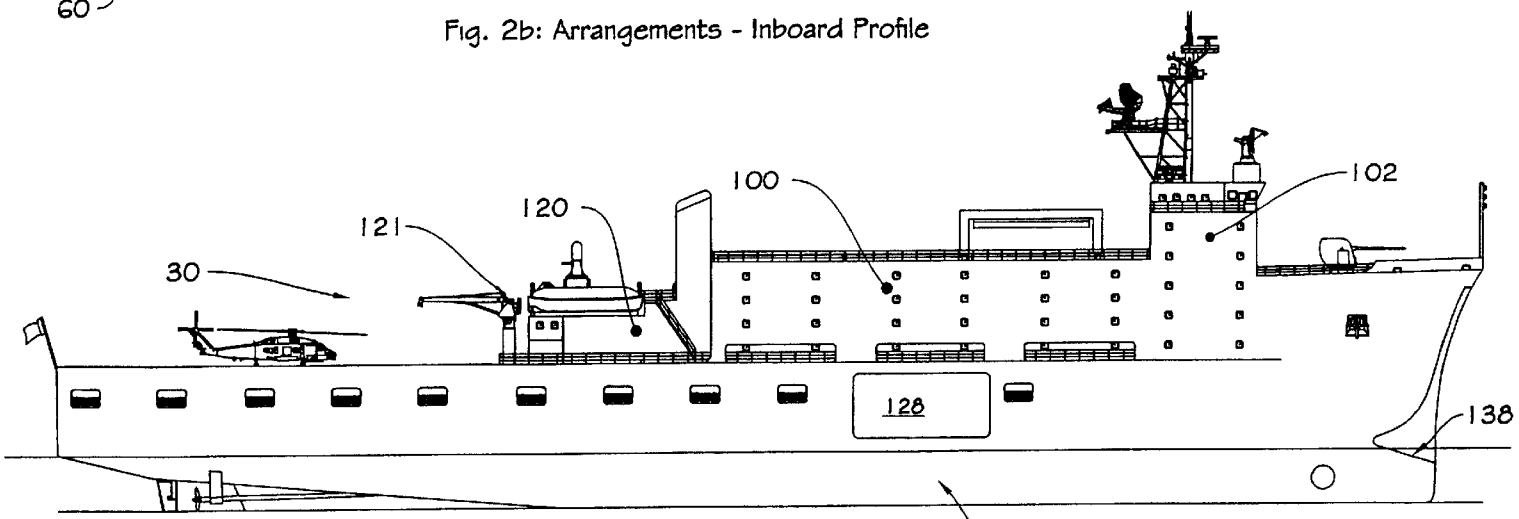
Figure 2a: Outboard Profile

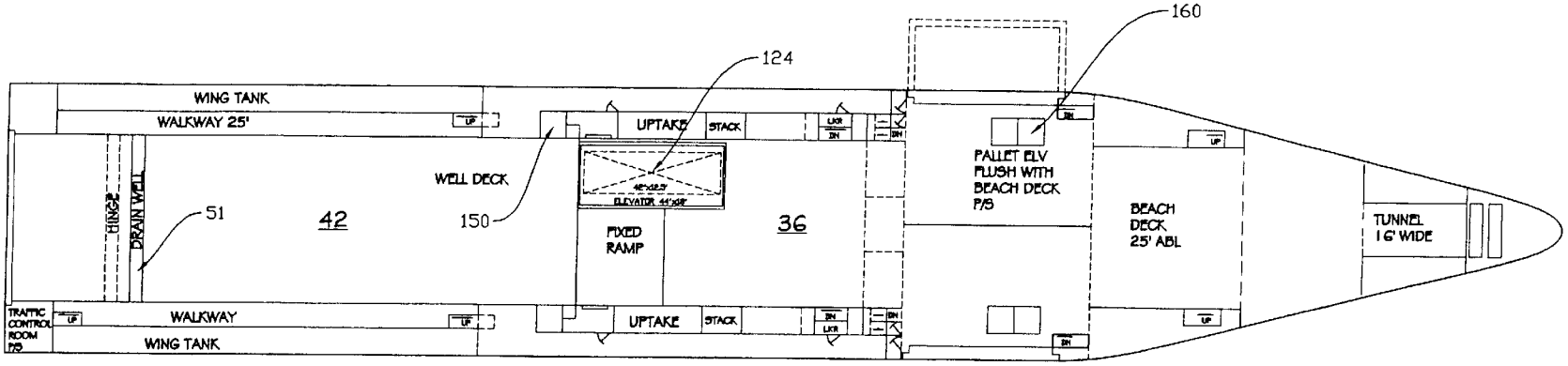
Figure 3b: Arrangements - Well Deck and Beach Deck
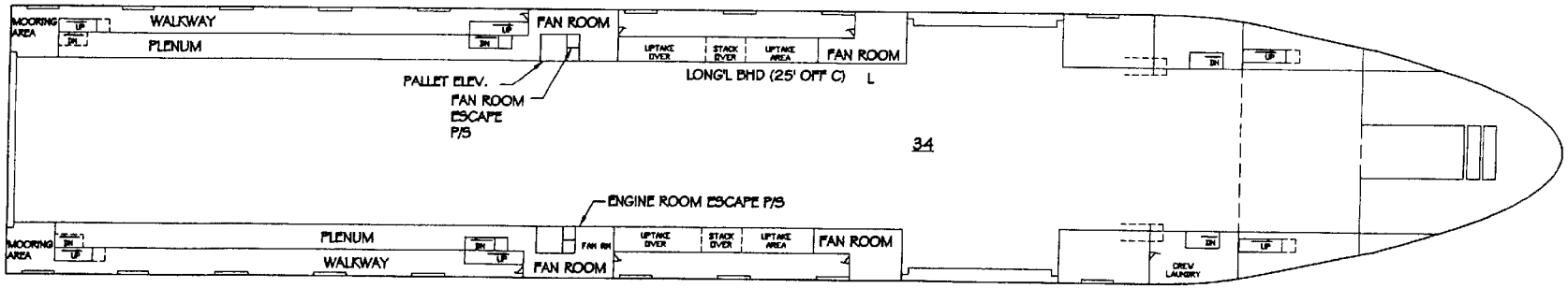
Figure 3a: Arrangements - "A" Flat

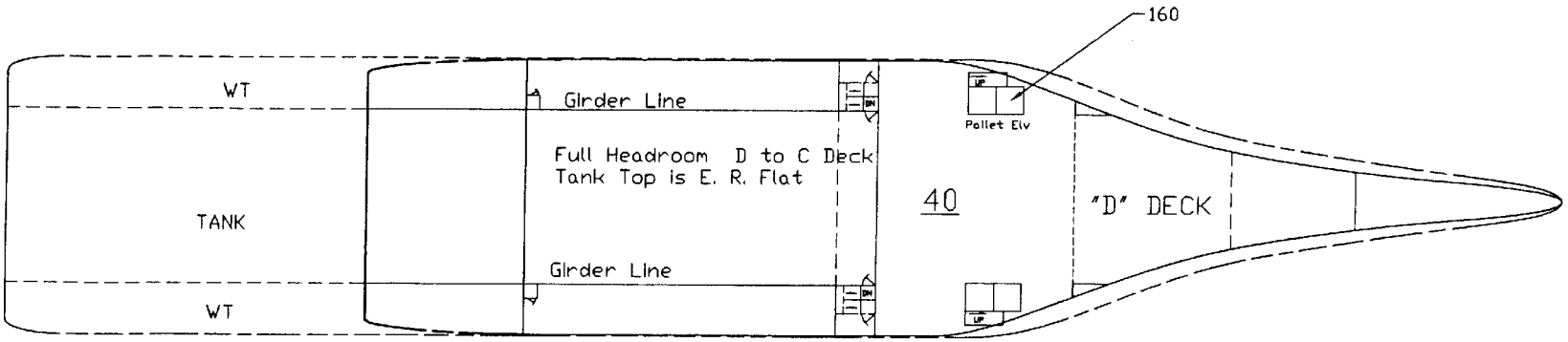
Figure 3d: Arrangements - "D" Deck
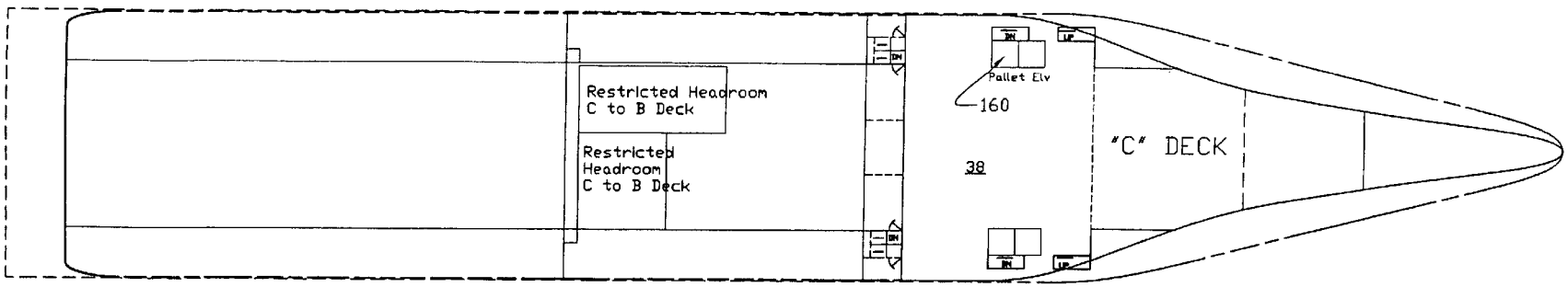
Figure 3c: Arrangements - "C" Deck

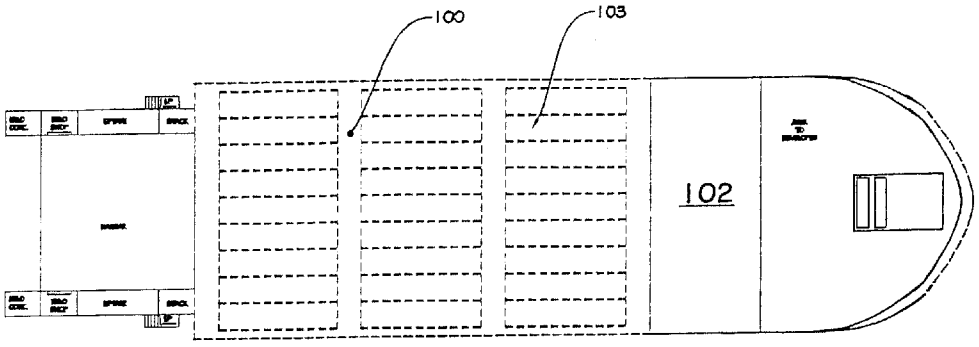
Figure 4b: Arrangements - Main Deck - Hangar & Container Compartment
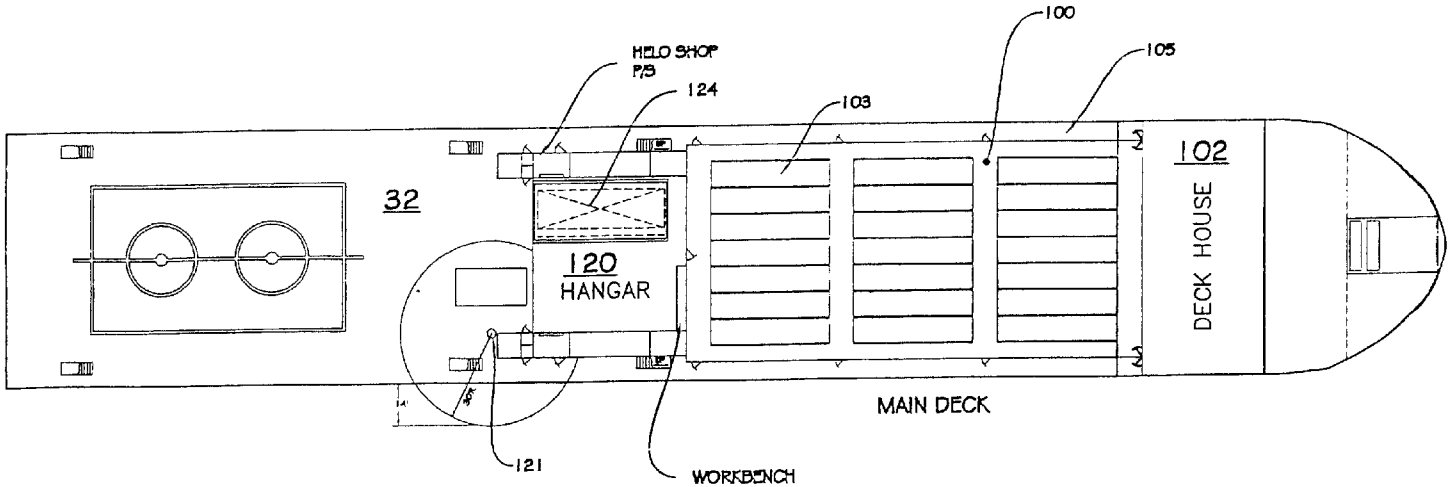
Figure 4a: Arrangements - Main Deck

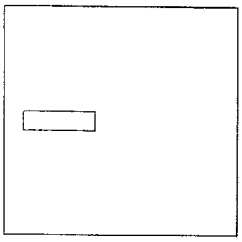
Figure 5f 116-05 LEVEL
ONE MAN
BRIDGE
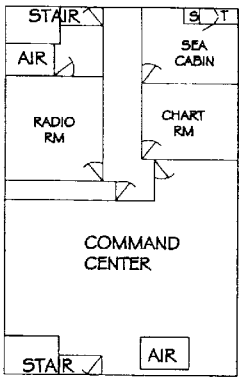
Figure 5e 114-04 LEVEL
RADIO, NAV
COMMAND
CENTER
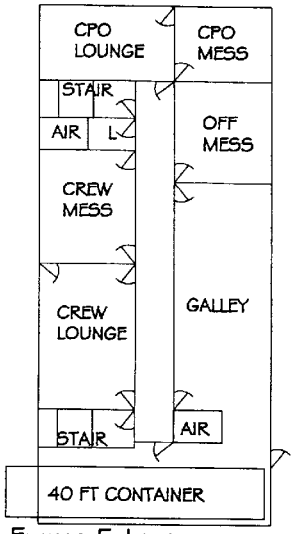
Figure 5d 110-03 LEVEL
GALLEY & MESS
CREW & CPO LOUNGE
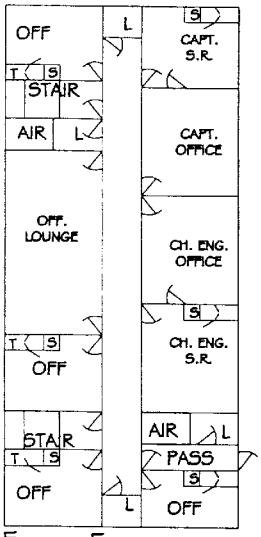
Figure 5c 108-02 LEVEL
3 OFF
CAPT
CH ENG
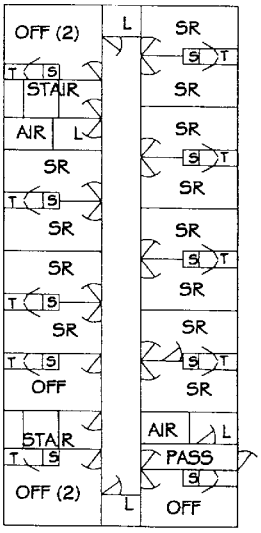
Figure 5b 106-01 LEVEL
24 BERTHS
6 OFICERS
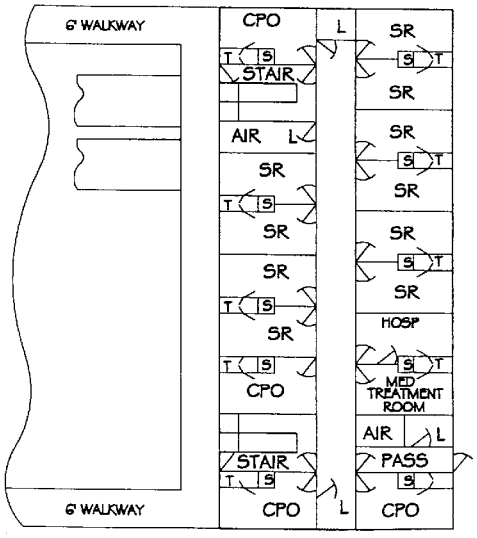
Figure 5a 104-MAIN DECK
20 BERTHS
8 CPO
Figure 5: Arrangements - Deckhouse

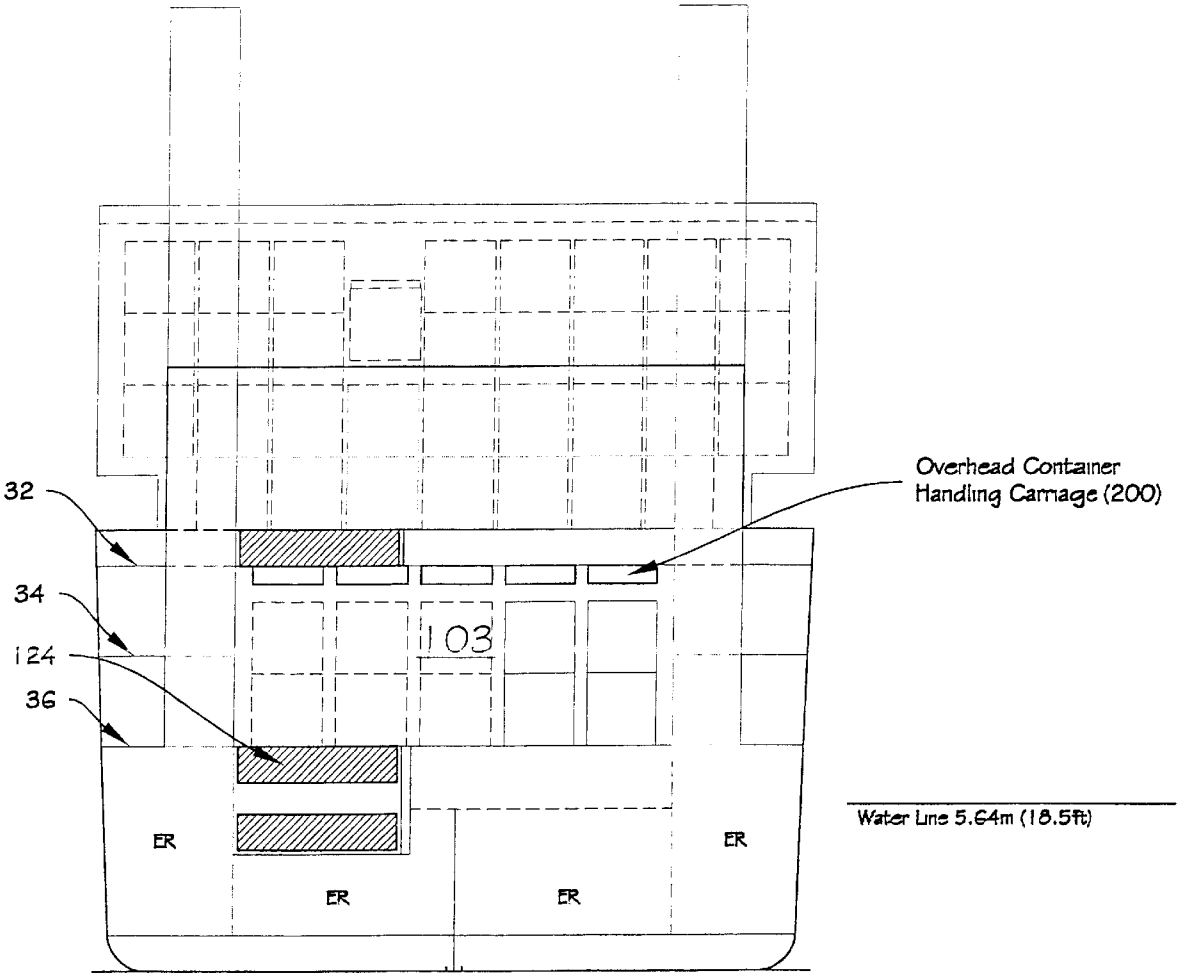
Figure 6a: Section Through Hanger and Engine Room

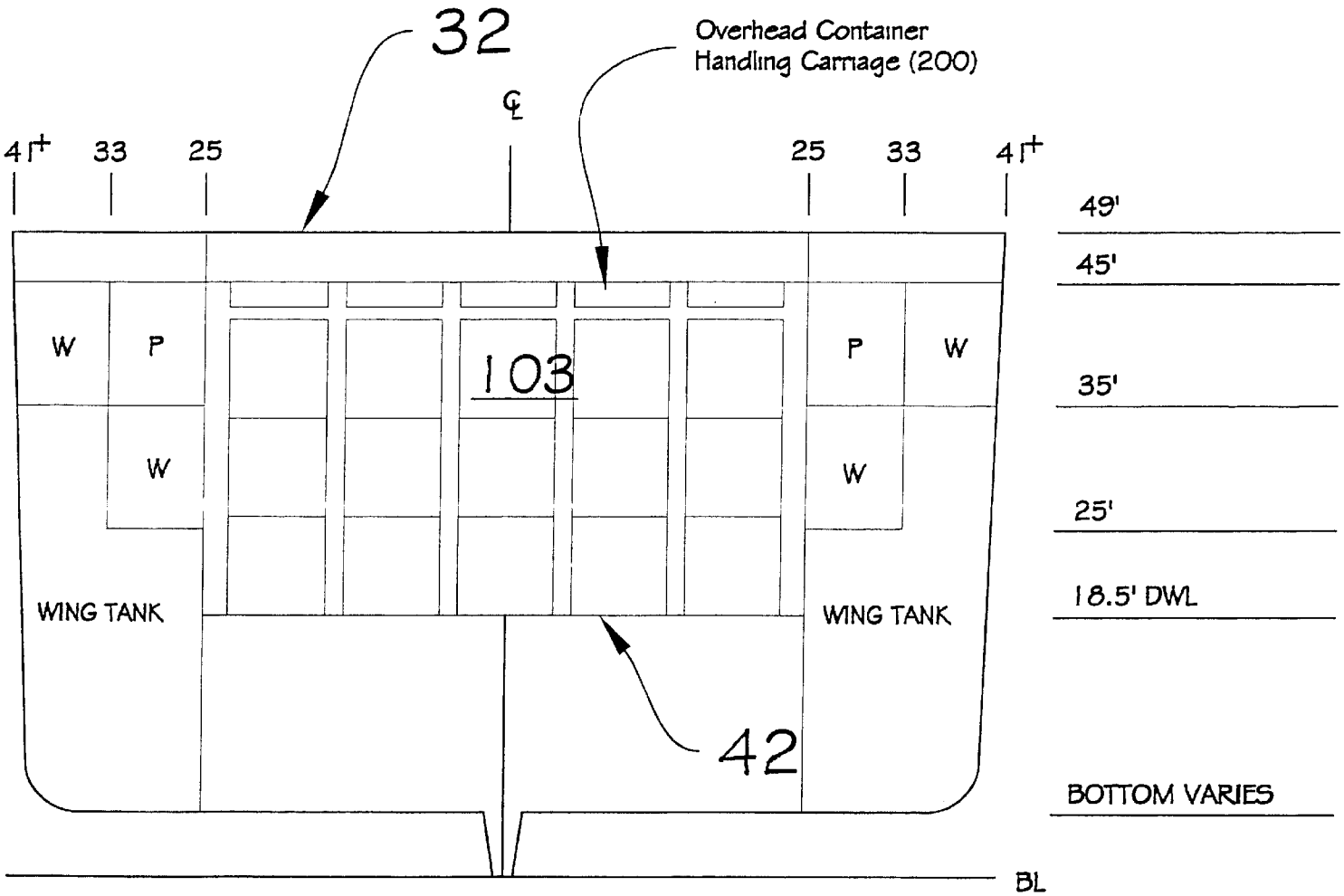
Figure 6b: Section Through Beach Deck and Sideport Doors

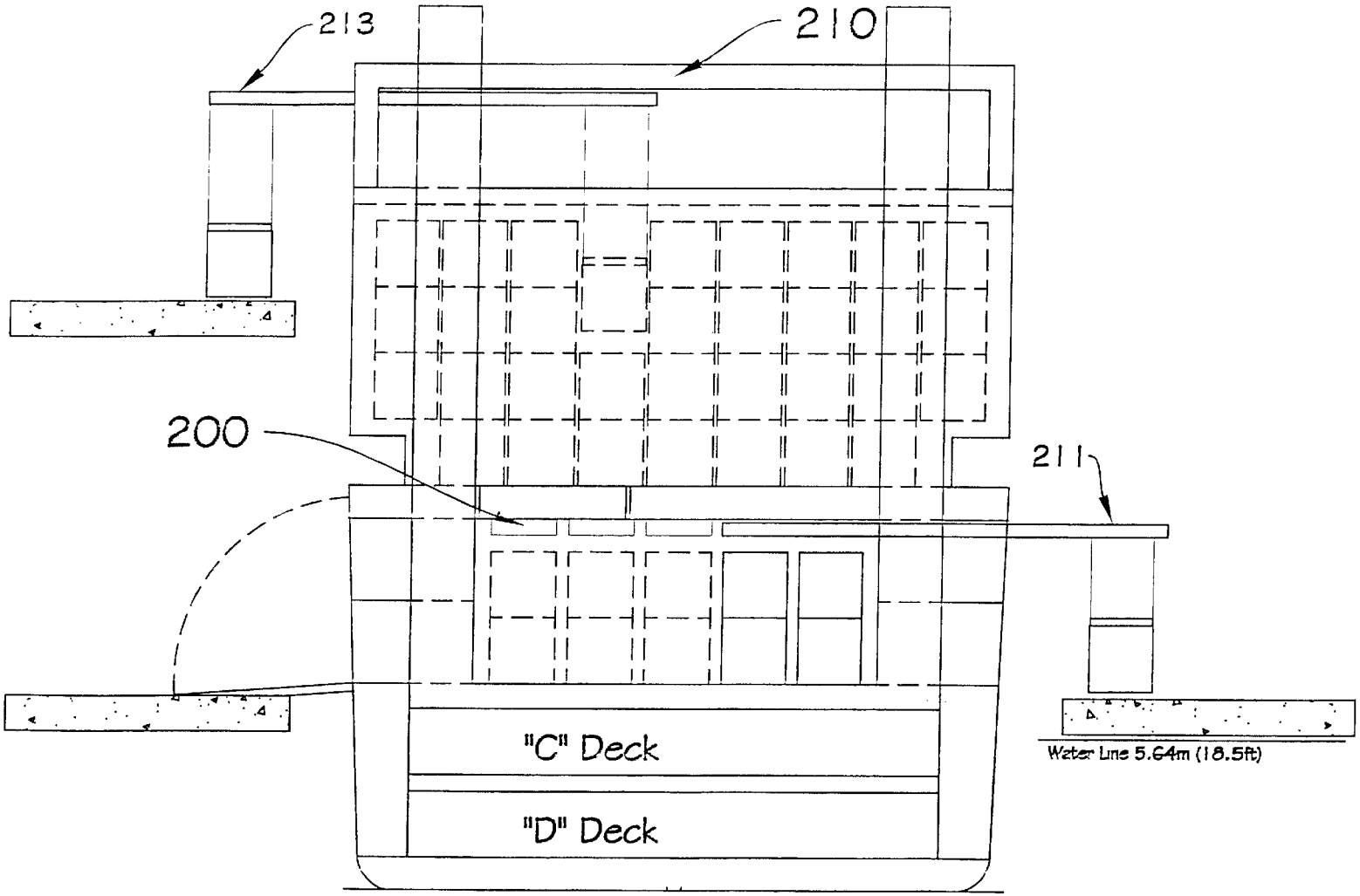
Figure 6c: Section Through Beach Deck and Sideport Doors

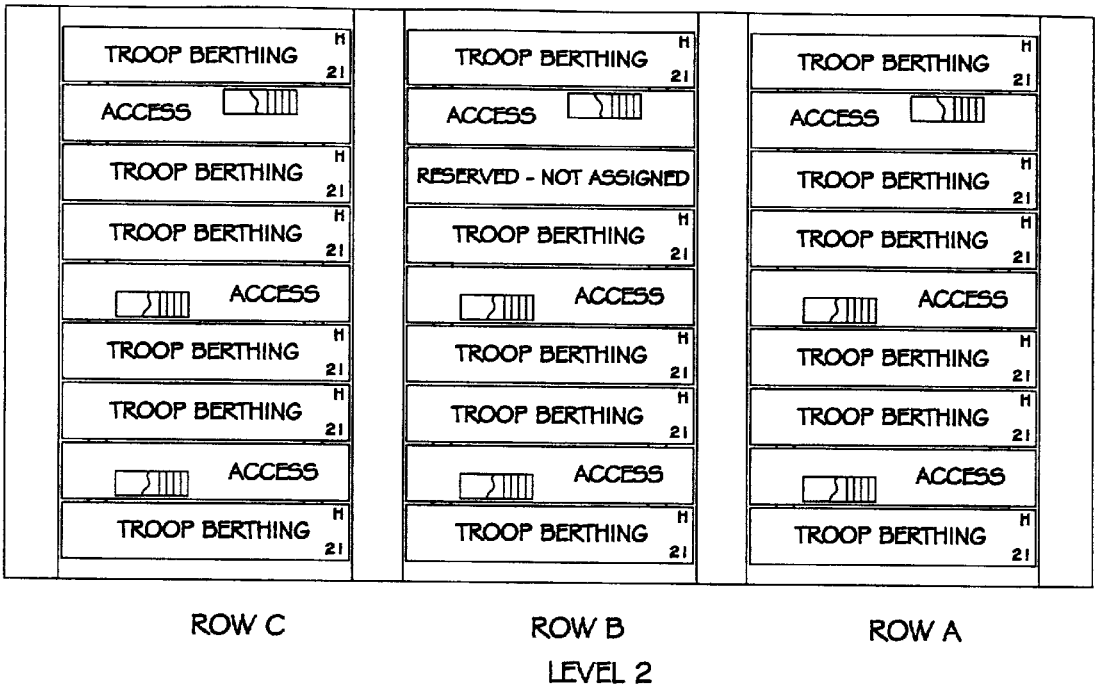
Figure 7b: Container Compartment - Modular Troop Container Arrangement - Level 2
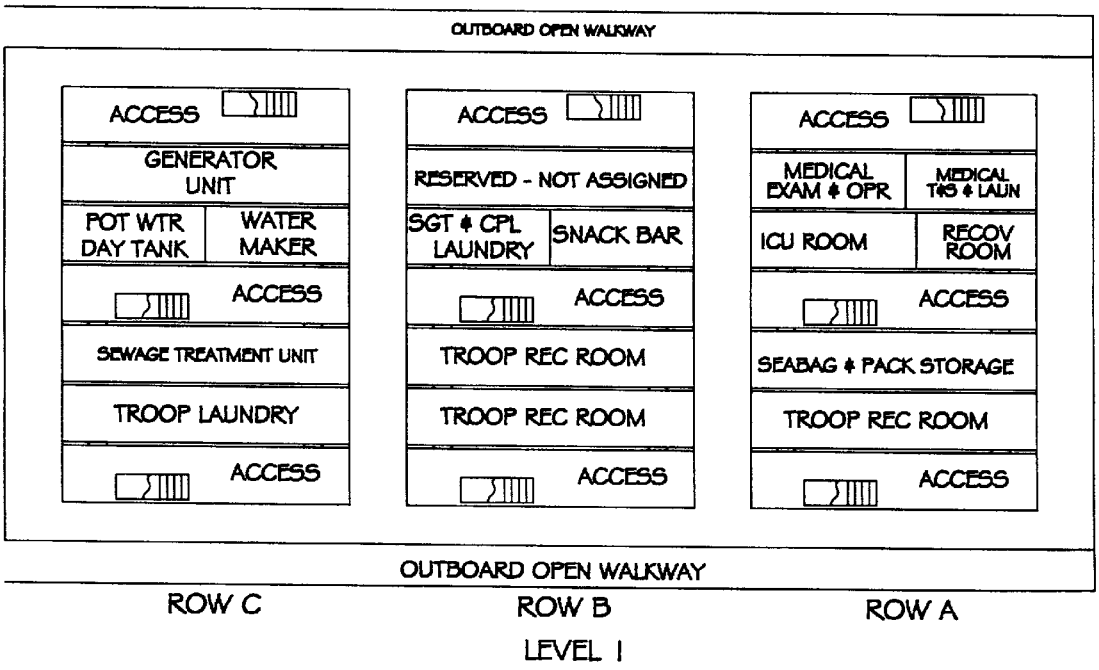
Figure 7a: Container Compartment - Modular Troop Container Arrangement - Level 1

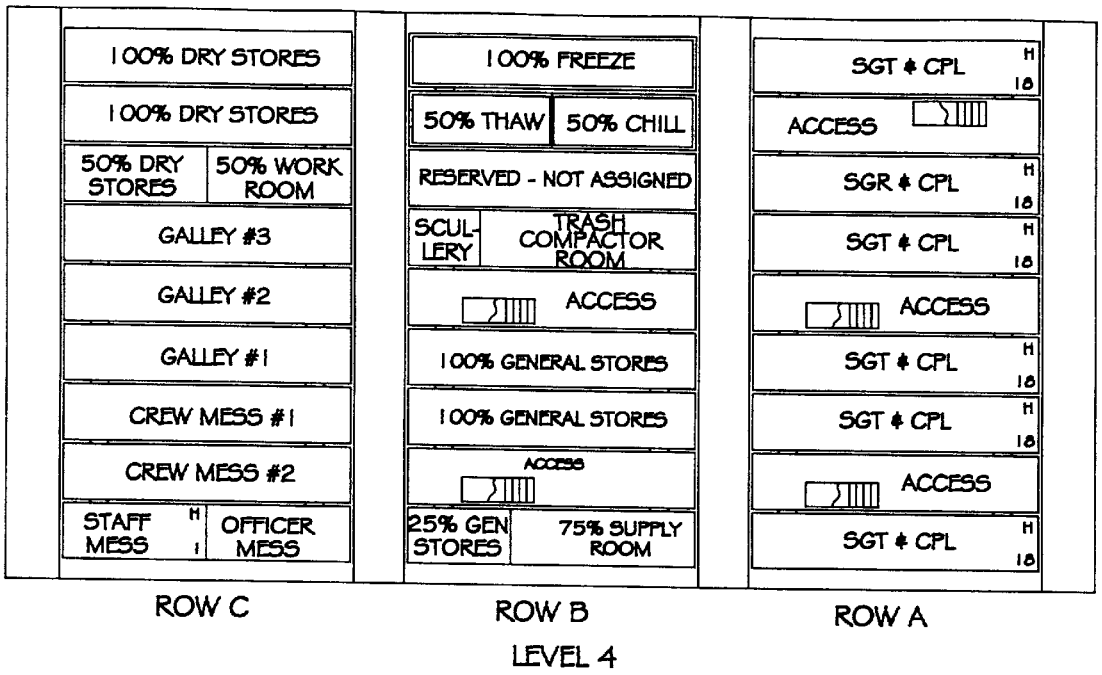
Figure 7d: Container Compartment - Modular Troop Container Arrangement - Level 4
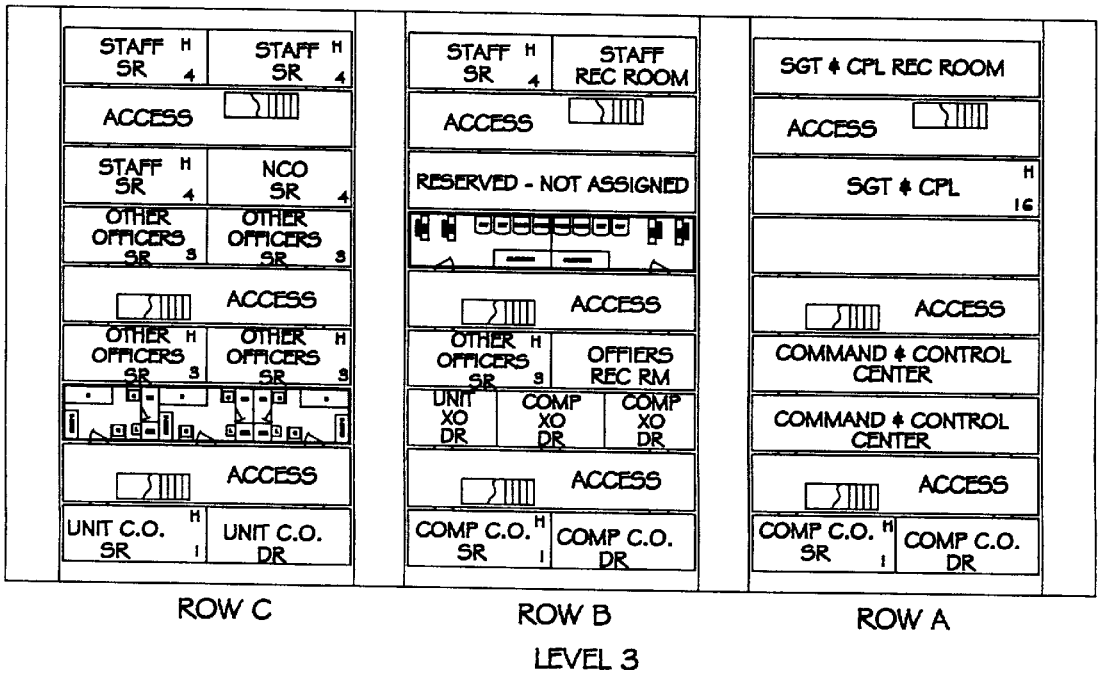
Figure 7c: Container Compartment - Modular Troop Container Arrangement - Level 3

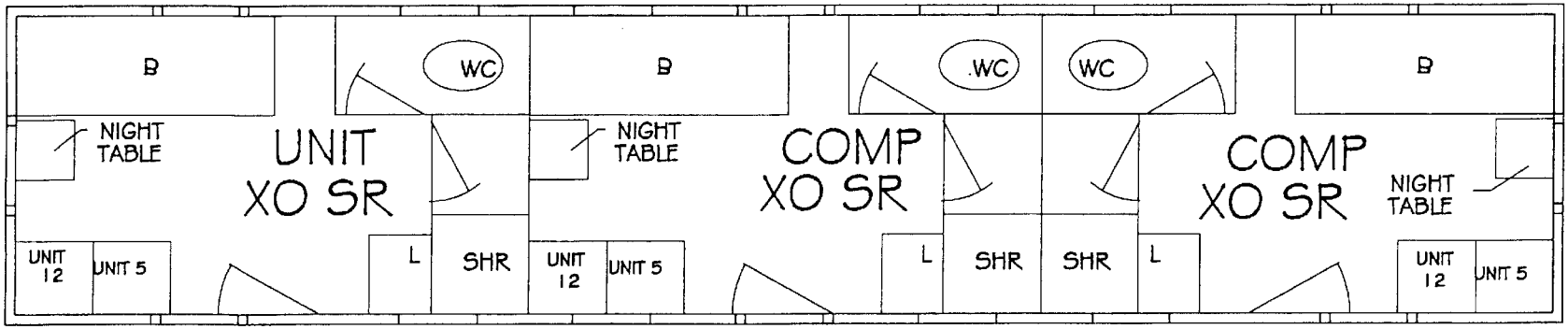
222 - Figure 8b: Internal Container Arrangements - 3-Man Berthing Module; 3 1-Man Ststerooms (Executive Officers)
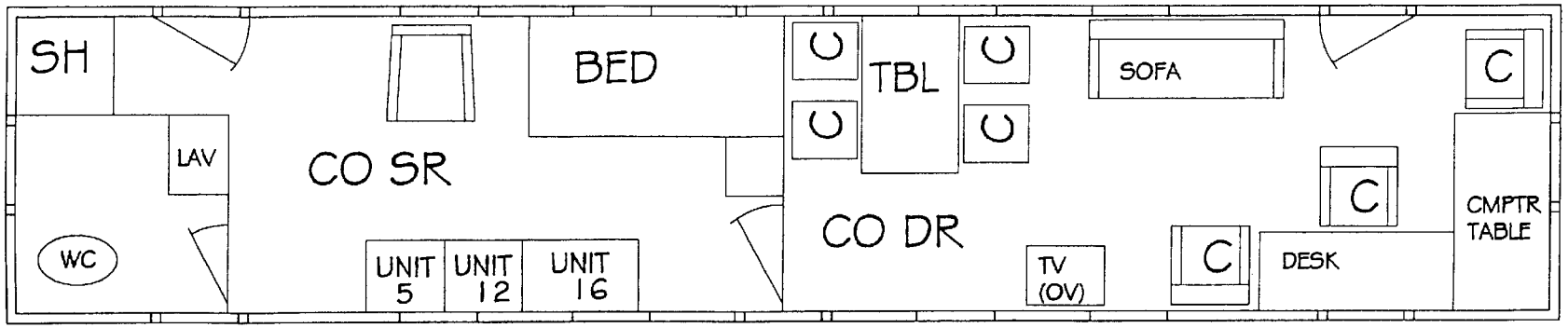
220 - Figure 8a: Internal Container Arrangements - 1-Man Berthing Module; 1 1-Man Stateroom/Office (Commanding Officers)

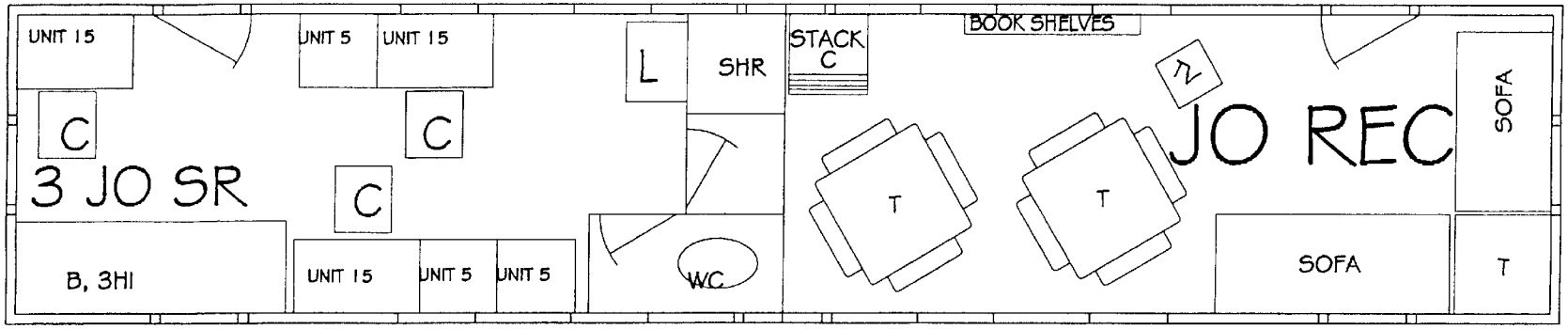
226 - Figure 8d: Internal Container Arrangements; - 3-Man Berthing/Recreation Module; 1-3Man Staterooms (Other Officers) & Officer Recreation Room
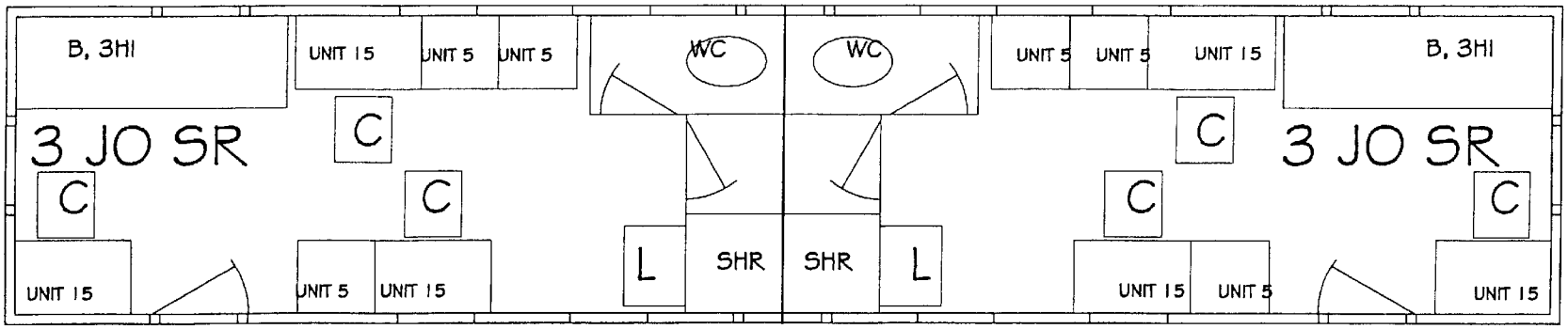
224 - Figure 8c: Internal Container Arrangements - 6-Man Berthing Module; 2 3-Man Staterooms (Other Officers)

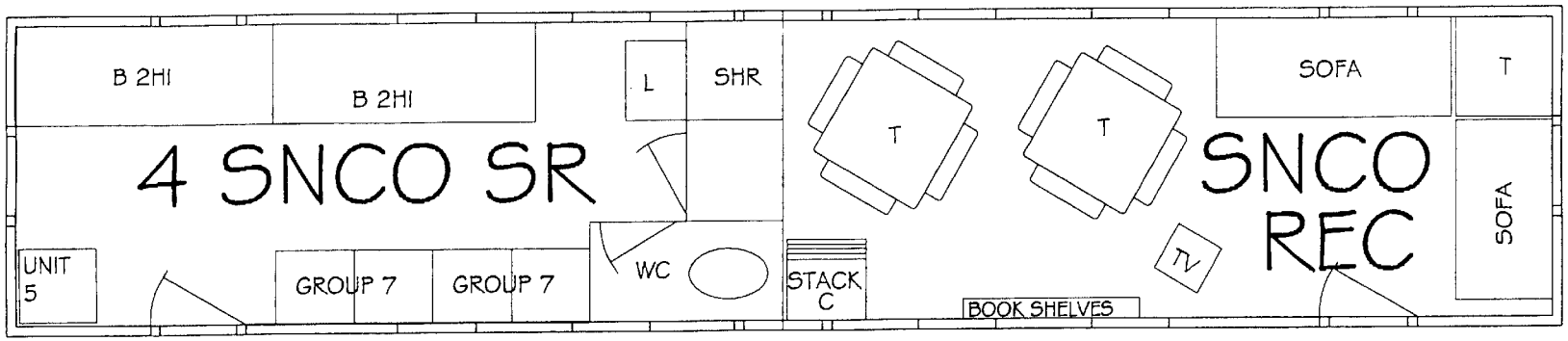
230 - Figure 8f: Internal Container Arrangements - 4-Man Berthing/Recreational Module
1 4-Man Staterooms (Senior Non-Commissionsd Officers) & SNCO Recreation Room
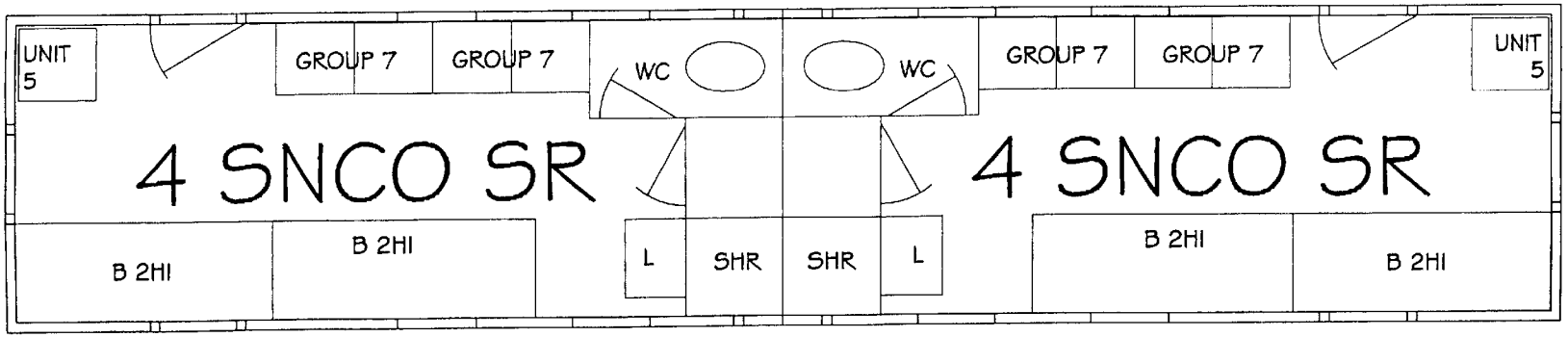
228 - Figure 8e: Internal Container Arrangements - 8-Man Berthing Module;
2 4-Man Staterooms (Senior Non-Commissioned Officers)

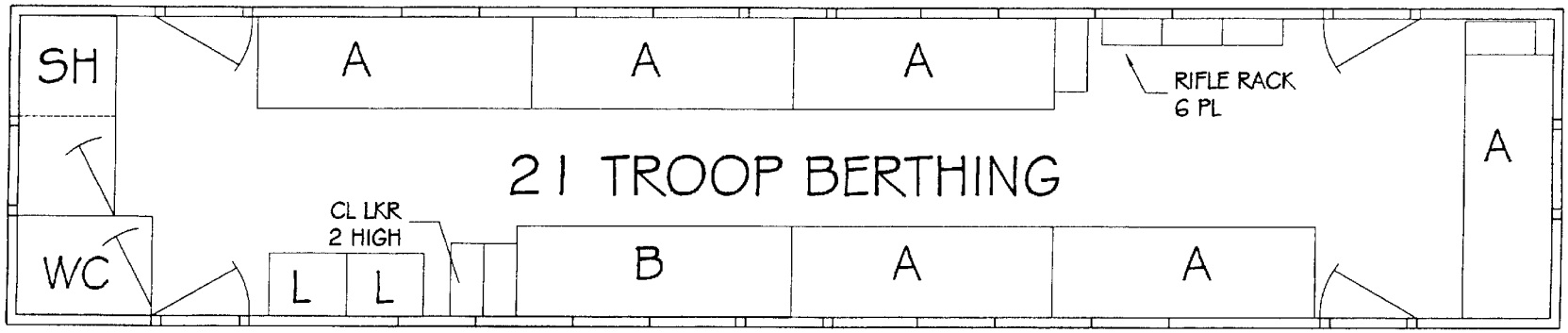
234 - Figure 8h: Internal Container Arrangements; 21-Man Berthing Module (Troops)
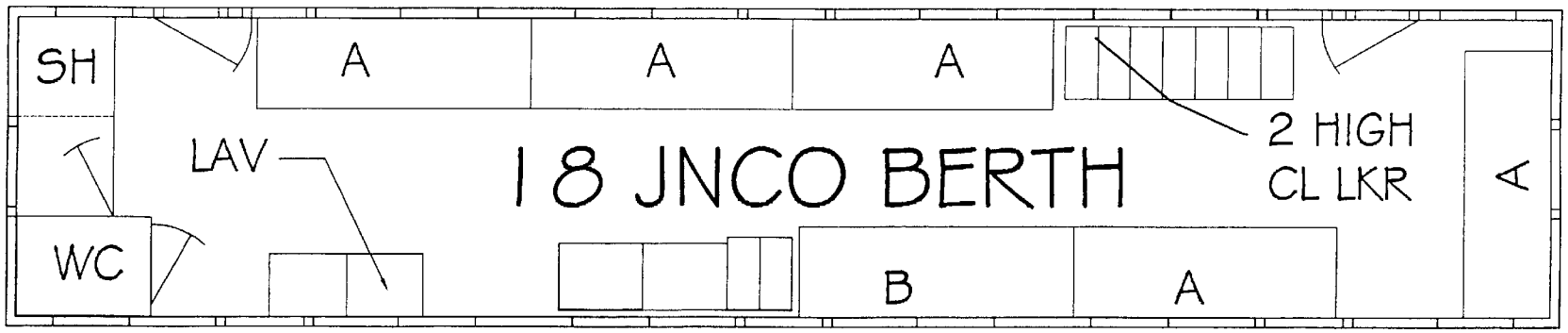
232 - Figure 8g: Internal Container Arrangements - 18-Man Berthing Module; (Junior Non-Commissioned Officers)

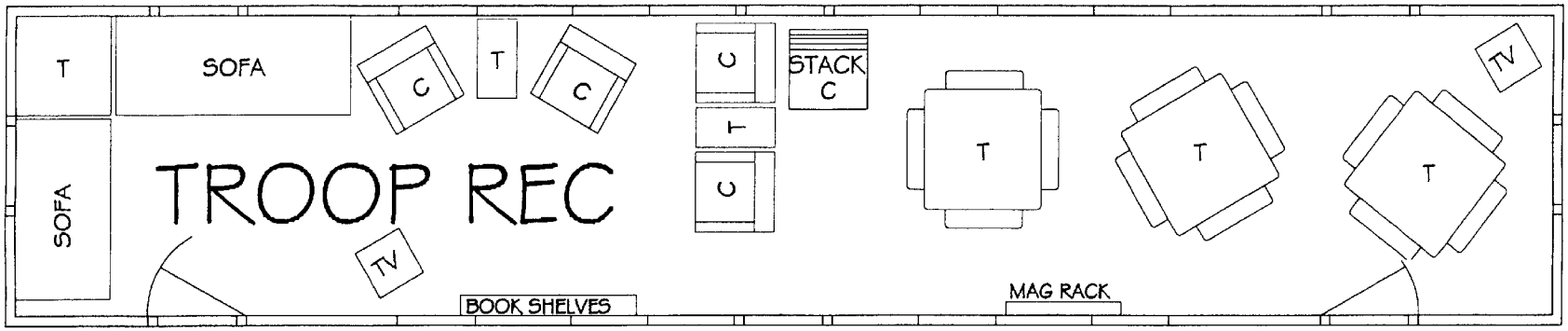
238 - Figure 8j: Internal Container Arrangements - Troop Recreation Room Module; (Troops)
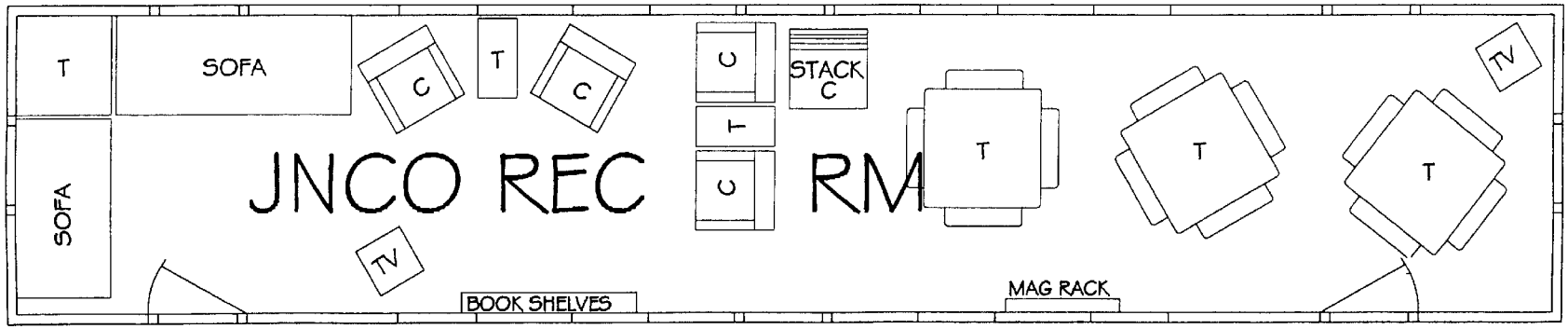
236 - Figure 8i: Internal Container Arrangements - JNCO Recreation Module; (Junior Non-Commissioned Officers)

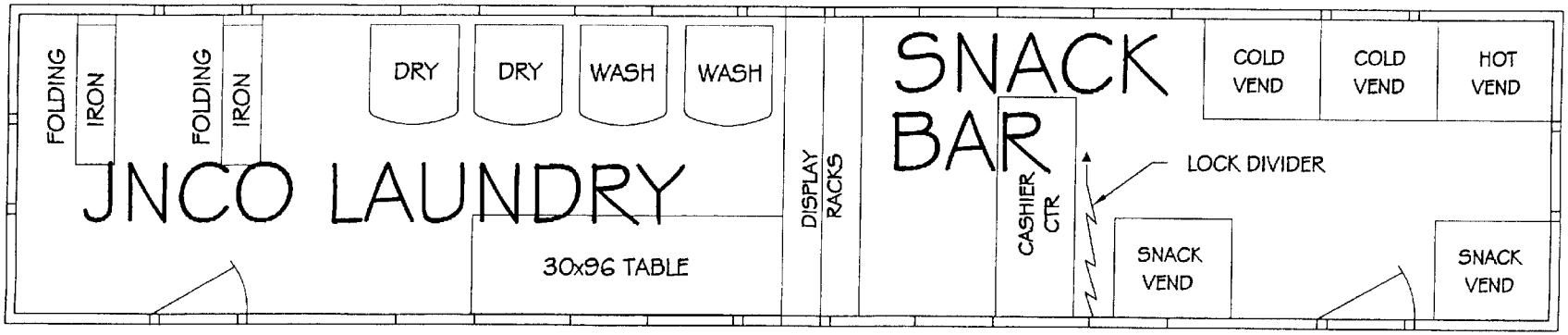
242 - Figure 8l: Internal Container Arrangements - JNCO Laundry/Snack Bar Module; (Junior Non-Commissioned Officers/Entie Unit)
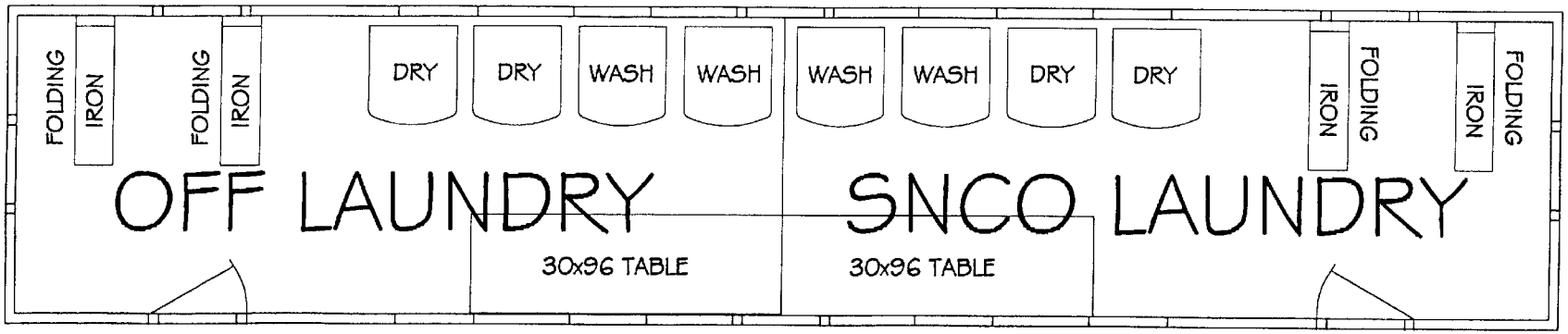
240 - Figure 8k: Internal Container Arrangements - Officer/SNCO Laundry Module; (Officers & Senior Non-Commissioned Officers)

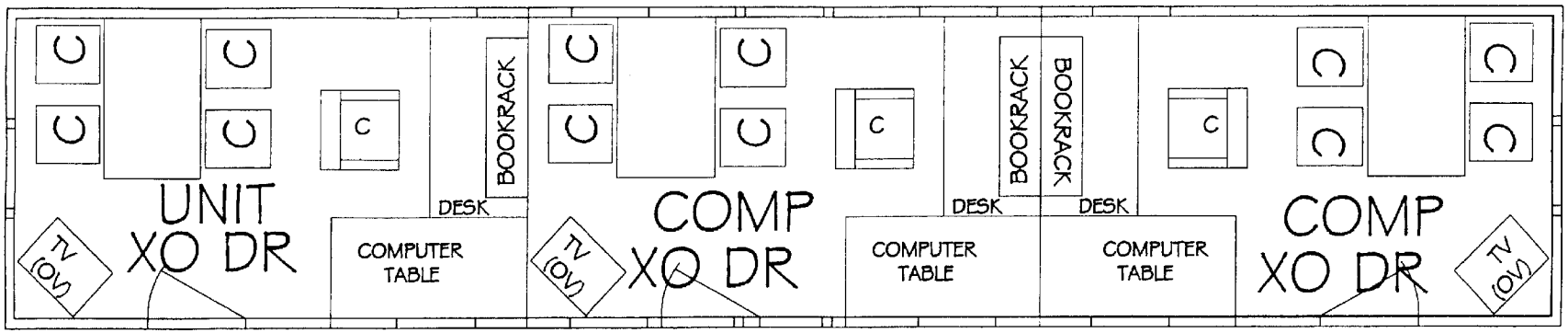
246 - Figure 8n: Internal Container Arrangements - 3-Office Module; (Command Offices)
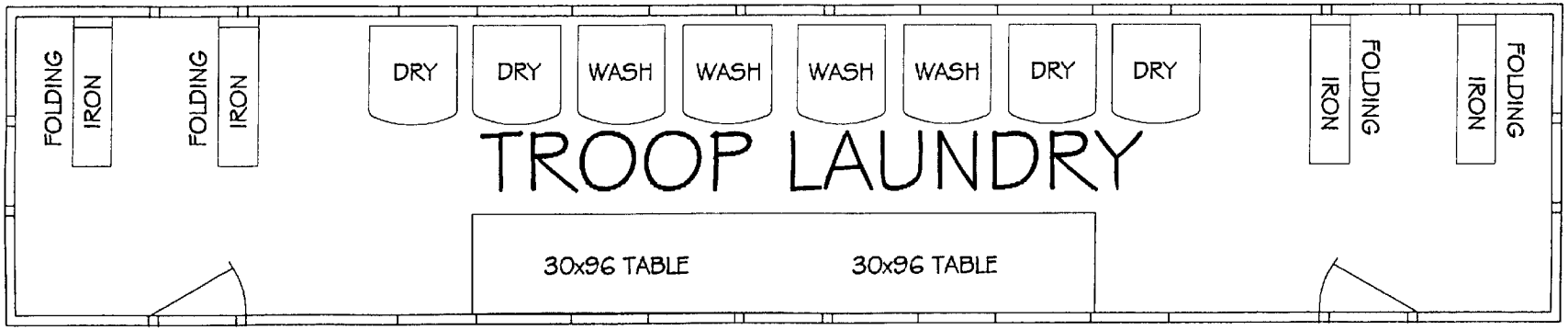
244 - Figure 8m: Internal Container Arrangements - Troop Laundry; (Troops)

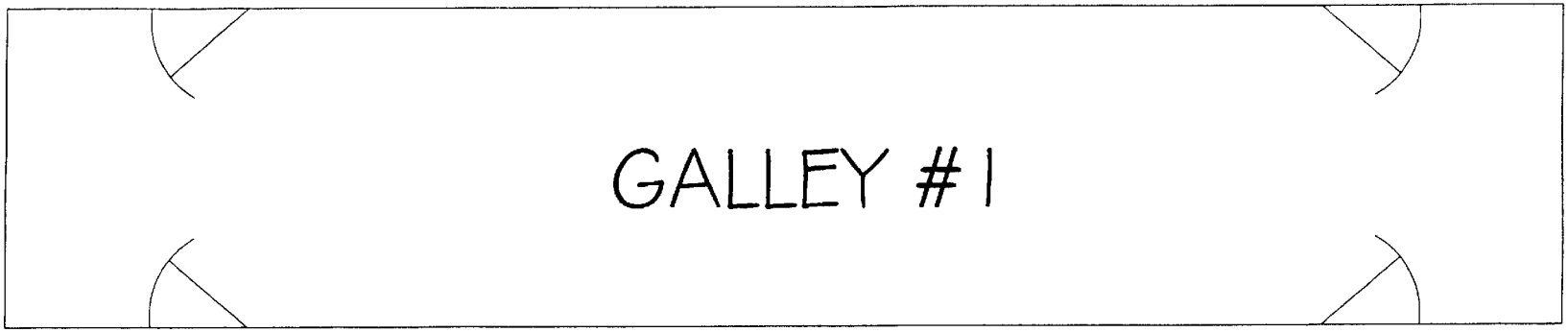
254 - Figure 8r: Internal Container Arrangements - Galley Module; (Kitchen #1)
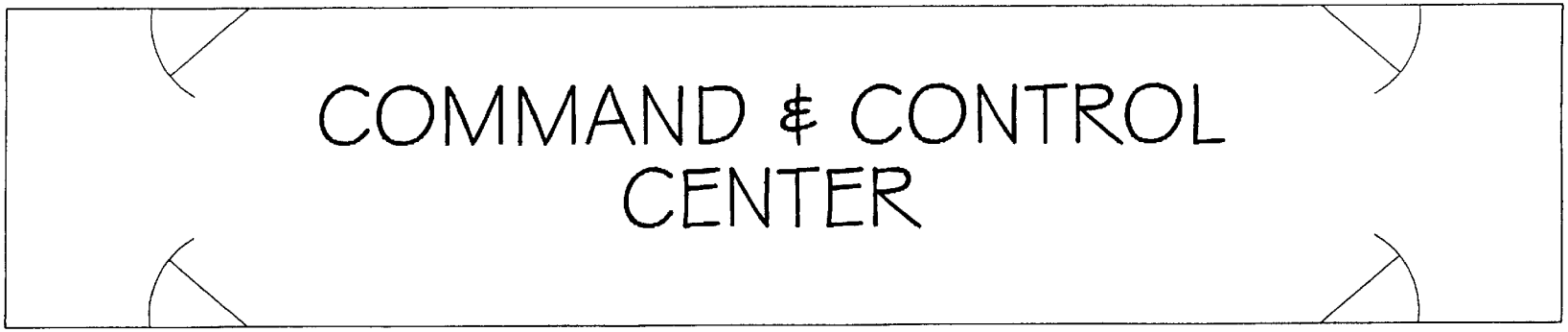
248 - Figure 8o: Internal Container Arrangements - Command & Control Module (Command & Conrtol)

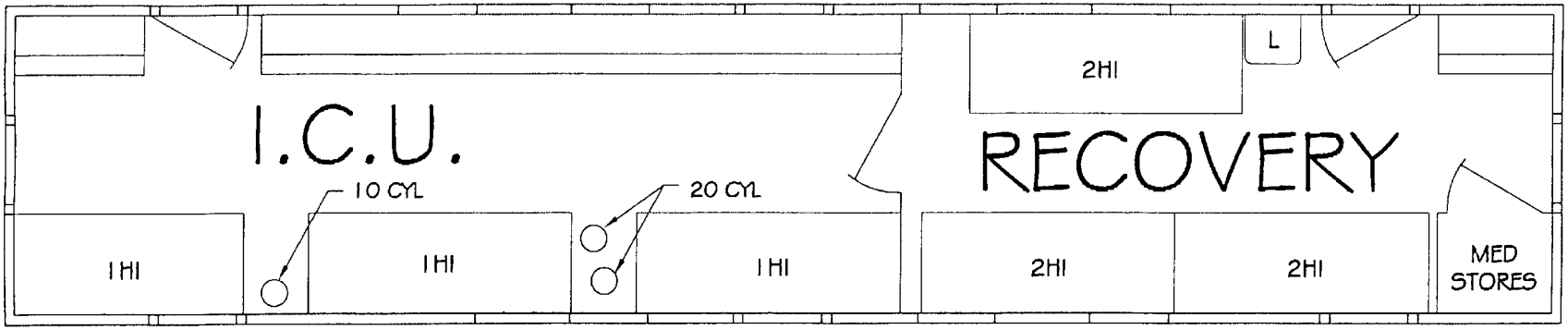
252 - Figure 8q: Internal Container Arrangements - Medical Intensive Care Unit/Recovery Room Module
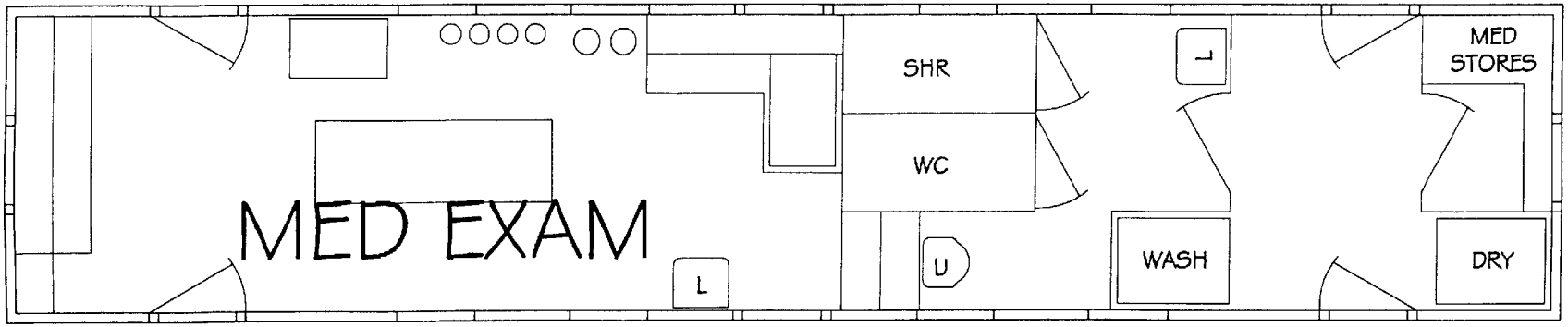
250 - Figure 8p: Internal Container Arrangements - Medical Examination Room/Head/Laundry Module

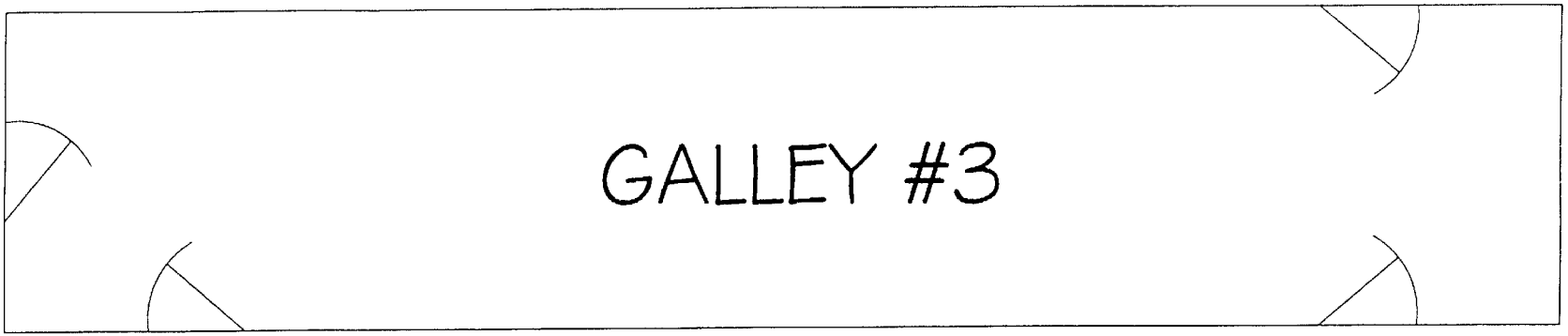
258 - Figure 8t: Internal Container Arrangements - Galley Module; Kitchen #3
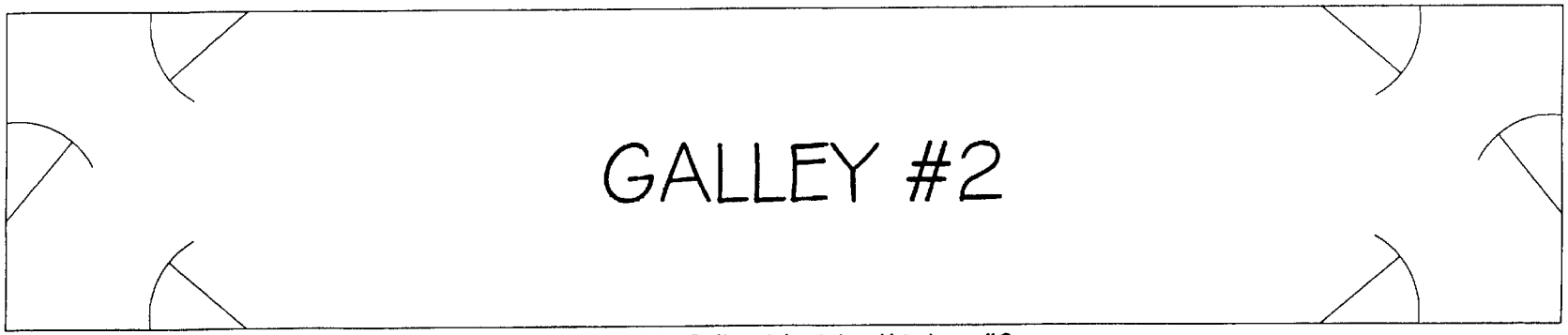
256 - Figure 8s: Internal Container Arrangements - Galley Module; Kitchen #2

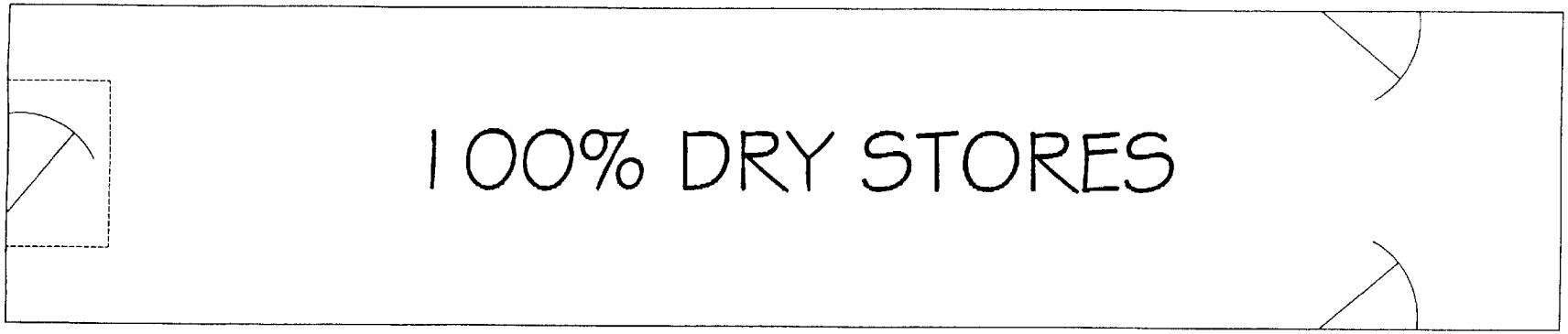
262 - Figure 8w: Internal Container Arrangements - 100% Dry Stores Module
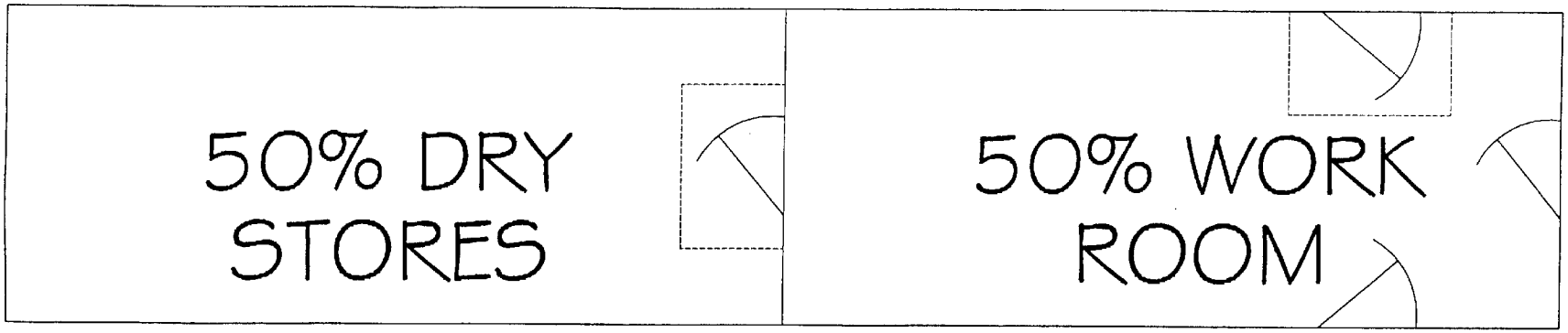
260 - Figure 8u: Internal Container Arrangements - 50% Work Room/50% Dry Stores Module

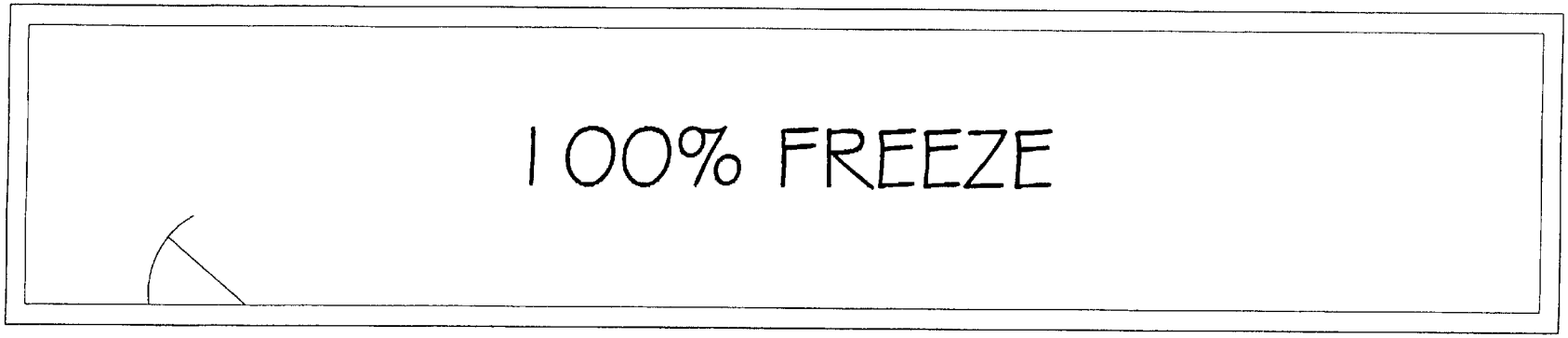
266 - Figure 8y: Internal Container Arrangements - Galley Module; 100% Freezer
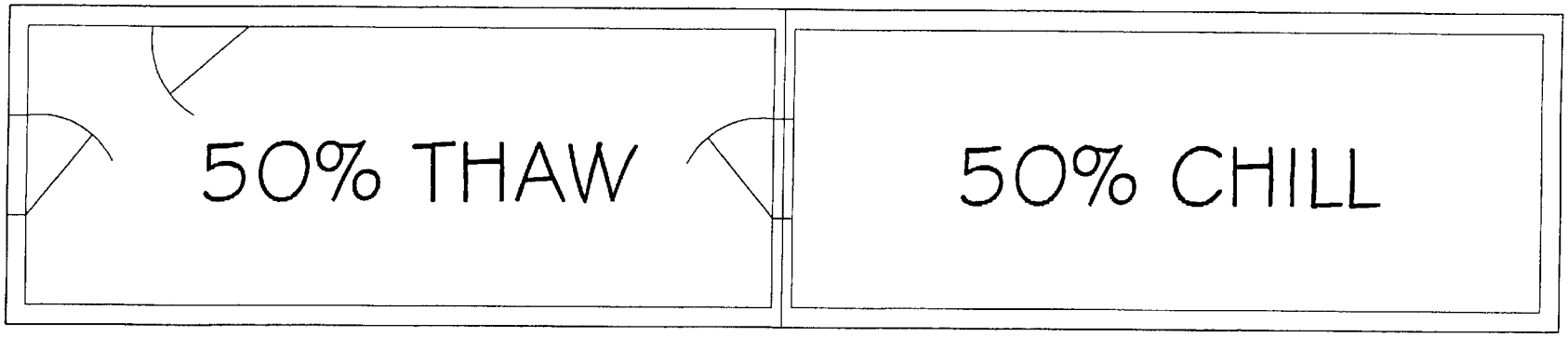
264 - Figure 8x: Internal Container Arrangements - Galley Module; 50% Thaw Room/50% Chill Room

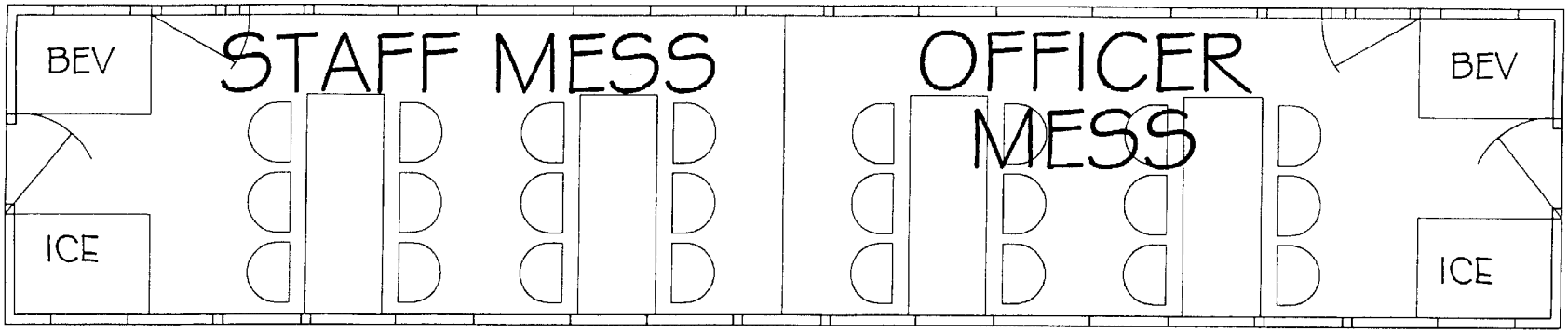
270 - Figure 8aa: Internal Container Arrangements - Galley Module; 12-Seat Officers Mess/12-Seat SNCO Mess
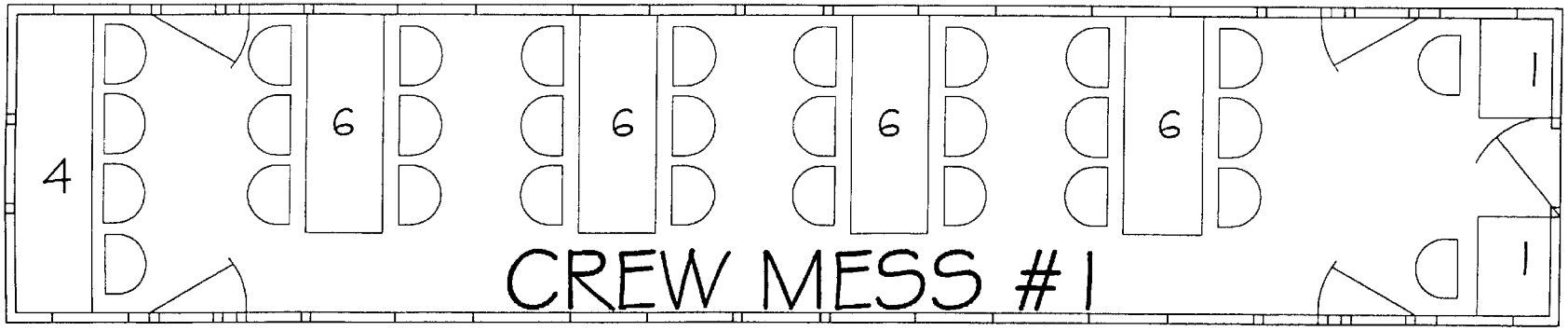
268 - Figure 8z: Internal Container Arrangements - Galley Module; 30-Seat Crews Mess

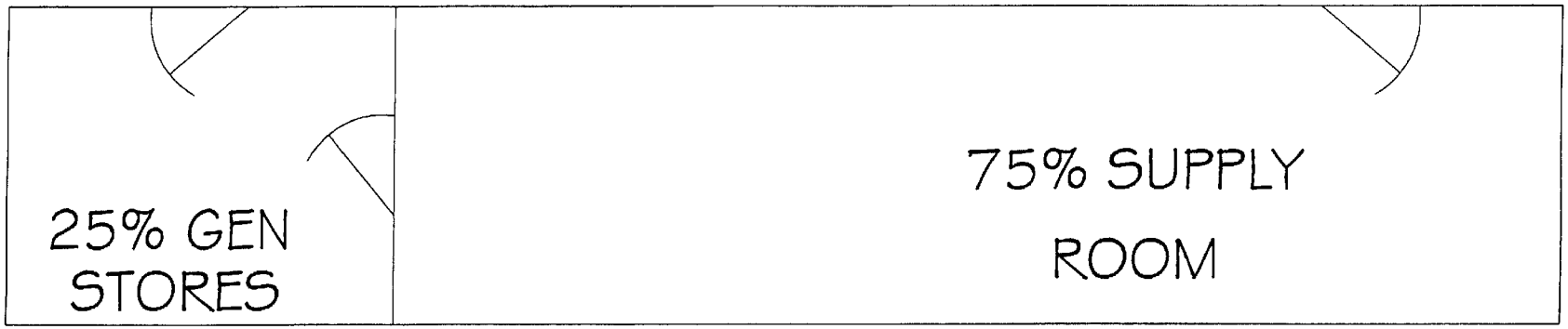
274 - Figure 8ac: Internal Container Arrangements - 75% Supply Issue Room/25% General Stores Module
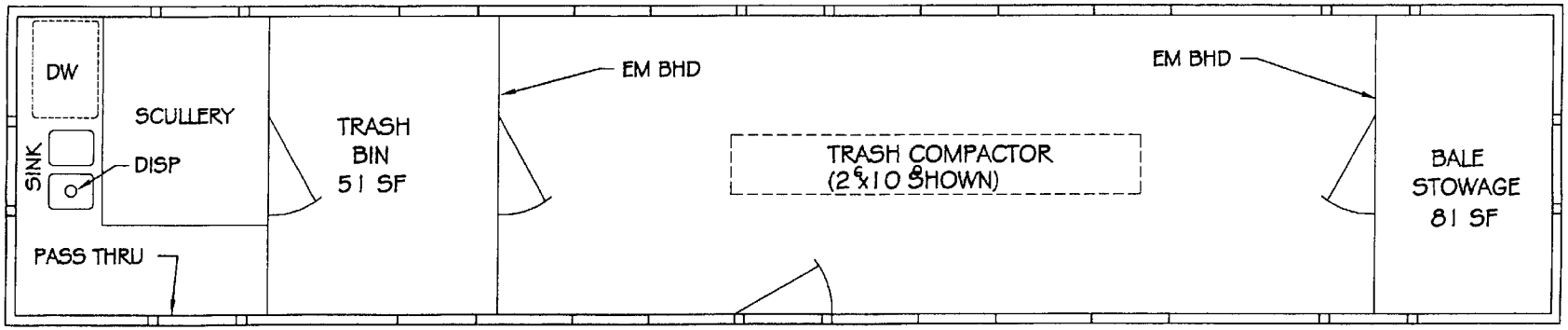
272 - Figure 8ab: Internal Container Arrangements - Scullery/Trash Compactor Module

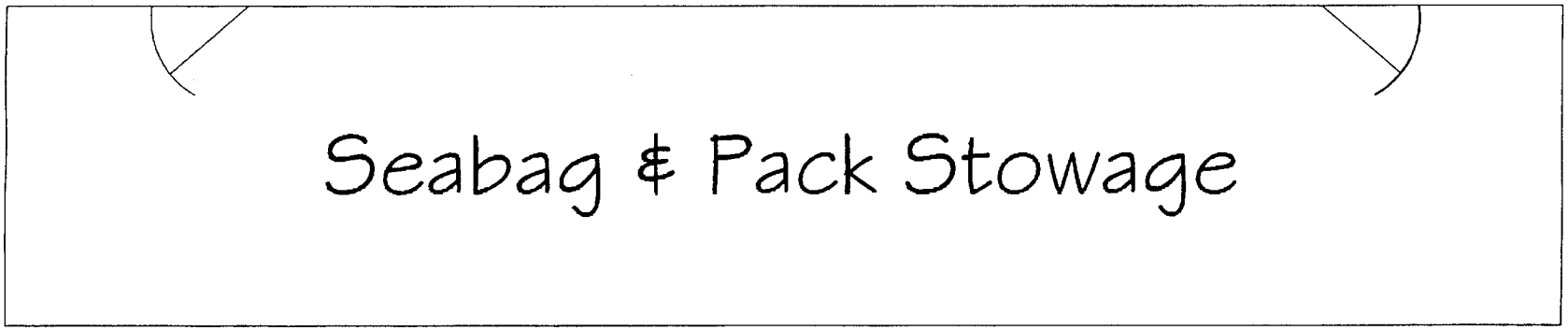
278 - Figure 8ae: Internal Container Arrangements - Seabag & Pack Stowage Module
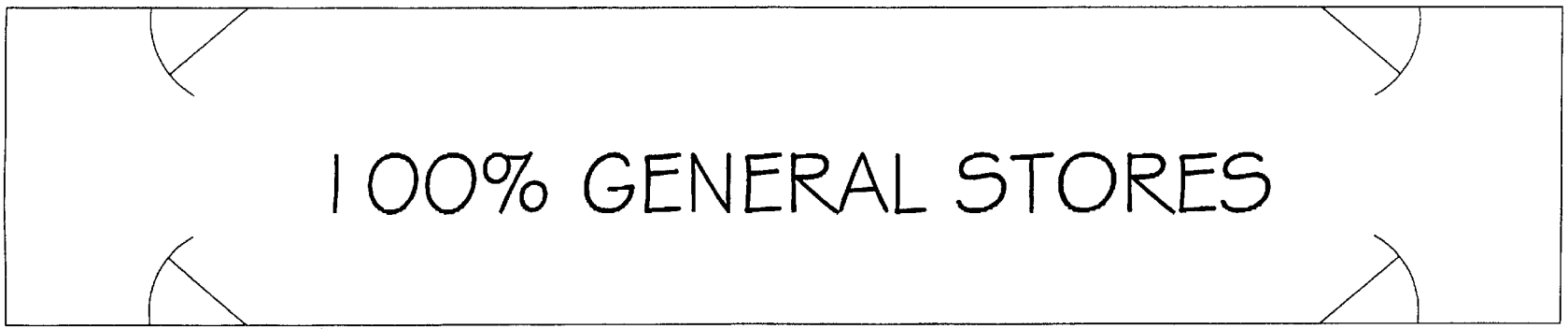
276 - Figure 8ad: Internal Container Arrangements - 100% General Stores Module

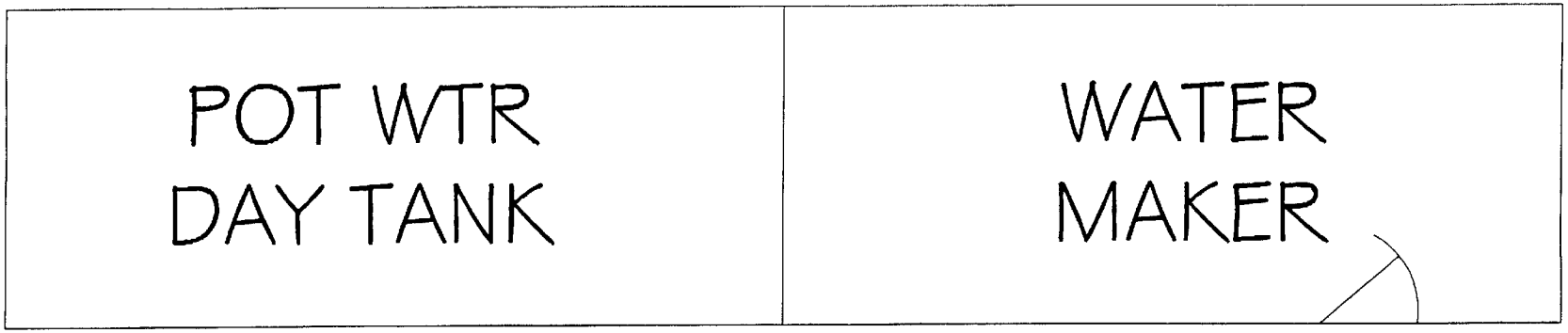
282 - Figure 8ag: Internal Container Arrangements - Desalination/Potable Water Day Tank Module
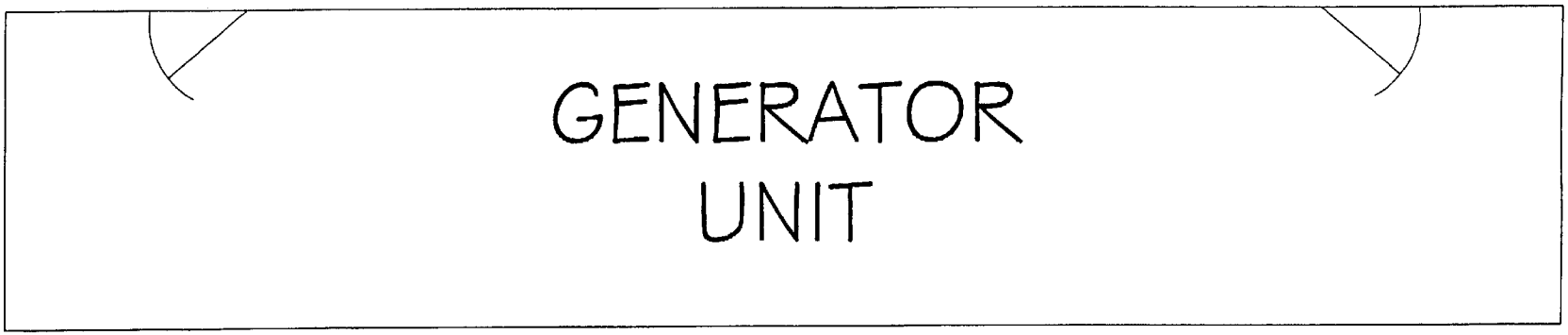
280 - Figure 8af: Internal Container Arrangements - Diesel Generator Module

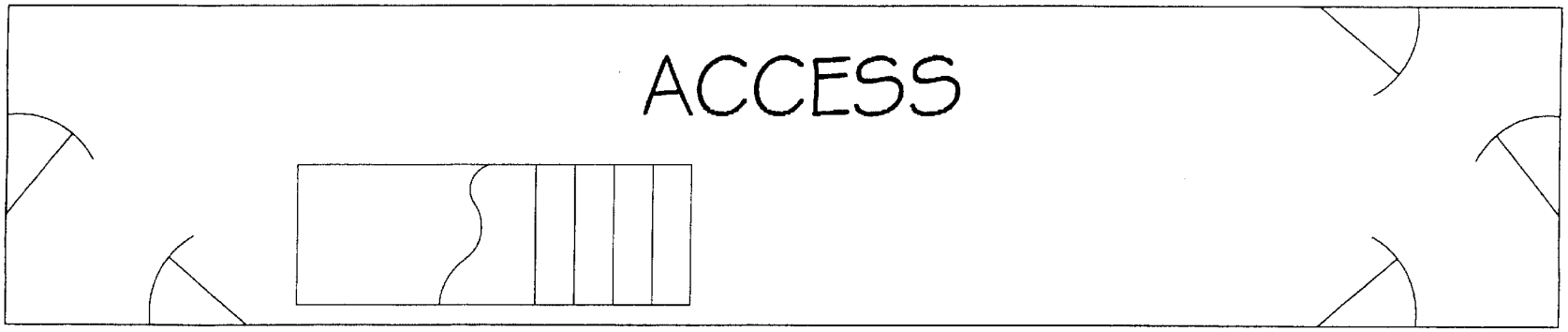
286 - Figure 8ai: Internal Container Arrangements - Access Module; (Passageway & Stair Trunk)
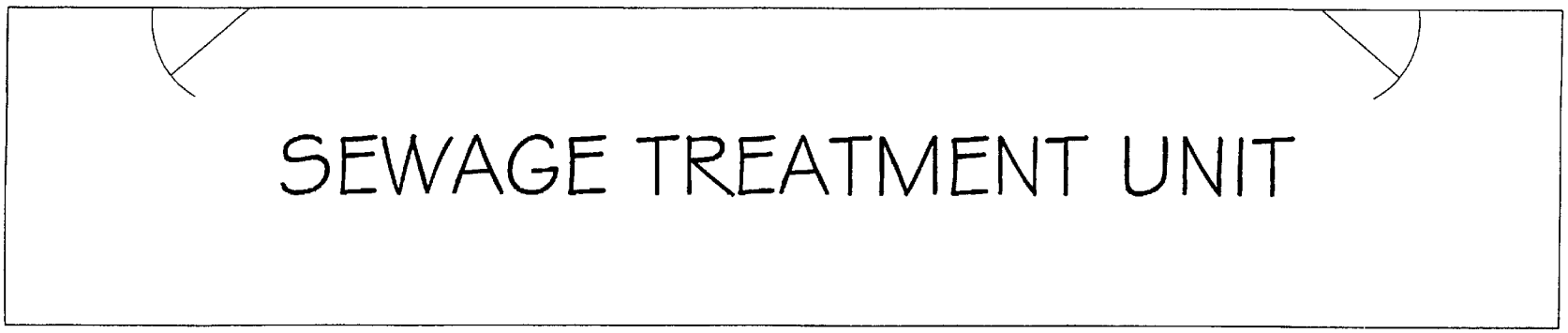
284 - Figure 8ah: Internal Container Arrangements - Black & Grey Water Sewage Treatment Module

VESSEL HAVING A STANDARDIZED HULL CAPABLE OF HAVING A PLURALITY OF OPTIONAL AND OPERATIONAL MODULAR STRUCTURES AND METHOD OF CONSTRUCTION THEREFOR

TECHNICAL FIELD

The present invention relates to marine vessels and methods of construction therefor, and more particularly, to multi-purpose amphibious support vessels having a plurality of optional operational modular structures for carrying out a variety of missions.

BACKGROUND ART

There are a large number of classes of amphibious ships around the world with each having its basic specialized mission. For example, the U.S. Navy has (LCC) Amphibious Command Ship, (LHA) Amphibious Assault Ship (General Purpose), (LED) Amphibious Assault Ship (Multi-Purpose), (LKA) Amphibious Cargo Ship, (LPA) Amphibious Transport, (LPD) Amphibious Transport Dock, (LPH) Amphibious Assault Ship (Helicopter), (LSD) Dock Landing Ship, and (LST) Tank Landing Ship. Other amphibious ships are used commercially in missions such as Roll On/Roll Off (RO/RO) vehicle carriers, container carriers, and break bulk in open top containers.

The primary drawback of each of the above mentioned vessels is that each class of vessels is optimized for only a single specific mission. Many classes of vessels would be required to fulfill all the possible specific needs. The purchase cost for each vessel can be prohibitive as well as the maintenance and ongoing costs associated with each vessel. A need exists for a single vessel capable of carrying out all of the above described missions, or a selected combination thereof.

Furthermore, typically before construction, each amphibious support vessel must be custom configured depending upon its chosen mission. A need exists for a standardized multi-purpose amphibious support vessel having a standardized hull capable of having a plurality of optional operational structures for carrying out a variety of missions, and capable of receiving a plurality of modular habitable containers for supporting troops and the like. Because of the standardized hull design the optional operational features advantageously can be readily integrated into the vessel so that the vessel will be capable of carrying out a wide variety of operational missions with the optional operational structures selected before the vessel is constructed.

This standardized vessel would be of modular construction with areas of the vessel set aside to receive particular optional desired operational structures. The areas would be spaced apart allowing each of the operational structures to be incorporated into the vessel without interfering with each other.

The standardized amphibious support vessel would also simplify a post-construction modification should the need arise to change the configuration of the vessel for a different mission.

DISCLOSURE OF THE INVENTION

It is, therefore, an object of this invention to overcome to a large extent the above-mentioned needs.

Another object of the present invention is to provide a vessel which can carry out a wide variety of missions.

Yet another object of the present invention is to provide a vessel capable of having a plurality of operational structures.

Still another object of the present invention is to provide a standardized modularized vessel in which a customer can select one or more of a variety of operational structures so that the vessel can be outfitted to perform desired missions.

Still another object of the present invention is to provide a vessel capable of receiving a plurality of modular habitable containers.

These and other objects of the present invention are achieved by providing a vessel capable of having a plurality of the following structures. The vessel includes a hull having a cavity for receiving a plurality of modular containers. The vessel includes one or more of the following structures:

a bow ramp with clam shell doors;
side port doors and ramps;
internal overhead container handling system with transverse jib booms;
container stowage compartment;
exterior container crane;
forward pallet elevators;
aft pellet elevators;
a helicopter flight deck;
a helicopter hangar;
a cargo/helicopter elevator(s);
a stern ramp/gate;
a wet/dry well deck;
a dry beach deck;
a wet well ballast system;
a bow grounding ballast system.

These and other objects of the present invention are achieved by a method for structuring a vessel capable of having a plurality of the following structures. A hull is formed having a cavity for receiving a plurality of containers. One or more of the following structures are selected:

a bow ramp with clam shell doors;
side port doors and ramps;
internal overhead container handling system with transverse jib booms;
container stowage compartment;
exterior container crane;
forward pallet elevators;
aft pallet elevators;
a helicopter flight deck;
a helicopter hangar;
a cargo/helicopter elevators;
a stern ramp/gate;
a wet/dry well deck;
a dry beach deck;
a wet well ballast system;
a bow grounding ballast system.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF DRAWINGS

For a more complete understanding of the present invention and advantages thereof, reference is now made to the following description, taken in conjunction with the accompanying drawings in which like reference numbers indicate like features and wherein:

FIG. 1*a,* Lines Drawing: Buttock Lines, is a side elevation view of the hull configuration of the multi-purpose amphibious support vessel according to the present invention;

FIG. 1*b,* Lines Drawing:—Waterlines; is an exploded view of the hull showing various waterlines'

FIG. 1*c,* Lines Drawing: Body Plan; is a front elevation view of the hull of the present invention of FIG. 1*a* showing the sectional hull form at different longitudinal locations;

FIG. 2*a,* Outboard Profile, is a side elevation view of the multi-purpose amphibious support vessel according to the present invention including some of the operational features;

FIG. 2*b,* Inboard Profile, is an inboard side elevation view of the multi-purpose amphibious support vessel of FIG. 2*a;*

FIG. 3*a,* Arrangements—"A" Flat, is a plan view looking down on the "A" Flat shown in FIG. 2*b;*

FIG. 3*b,* Arrangements—Well Deck and Beach Deck, is a plan view looking down on the Well and Beach Decks as shown in FIG. 2*b;*

FIG. 3*c,* Arrangements—"C" Deck, is a plan view looking down on the "C" Deck as shown in FIG. 2*b;*

FIG. 3*d,* Arrangements—"D" Deck, is a plan view looking down on the "D" Deck as shown in FIG. 2*b;*

FIG. 4*a,* Arrangements—Main Deck, is a plan view looking down on the Main Deck as shown in FIG. 2*b;*

FIG. 4*b,* Arrangements—01, 02, & 03 Levels—Hangar and Container Compartment, is a plan view looking down on the Main Deck in way of the hanger and container compartment as shown in FIG. 2*b;*

FIG. 5*a,* Arrangements—Deck House—Main Deck, is a plan view of the deck house looking down on the Main Deck as shown in FIG. 2*b;*

FIG. 5*b,* Arrangements—Deck House—01 Level, is a plan view of the deck house looking down on the 01 Deck as shown in FIG. 2*b;*

FIG. 5*c,* Arrangements—Deck House—02 Level, is a plan view of the deck house looking down on the 02 Deck as shown in FIG. 2*b;*

FIG. 5*d,* Arrangements—Deck House—03 Level, is a plan view of the deck house looking down on the 03 Deck as shown in FIG. 2*b;*

FIG. 5*e,* Arrangements—Deck House—04 Level, is a plan view of the deck house looking down on the 04 Deck as shown in FIG. 2*b;*

FIG. 5*f,* Arrangements—Deck House—05 Level, is a plan view of the deck house looking down on the 05 Deck as shown in FIG. 2*b;*

FIG. 6*a,* Section Thru Hangar and Engine Room, is a cross-section view of the ship in way of the hangar and engine room taken along lines 6*a*—6*a* as shown in FIG. 2*b.*

FIG. 6*b,* Section Thru Well Deck, is a cross-section view of the ship in way of the well deck taken along lines 6*b*—6*b* as shown in FIG. 2*b;*

FIG. 6*c,* Section Thru Beach Deck and Sideport Doors, is a cross section view of the ship in way of the Beach Deck and the sideport doors taken along lines 6*c*—6*c* as shown in FIG. 2*b* shows the topside container crane and the interior overhead container handling system.

FIGS. 7*a*–7*d,* Container Compartment—Modular Troop Container Arrangement—Levels 1–4, shows one habitable container arrangement that accommodates and supports 500 troops.

FIGS. 8*a*–8*ai,* Internal Container Arrangements, depict interior furnishings and arrangements for various uses of container modules.

BEST MODE FOR CARRYING OUT THE INVENTION

Referring first to FIGS. 1*a*–1*c* and 2*a*–2*b,* a multi-purpose amphibious support vessel 30 is depicted which is constructed in accordance with the principles of the present invention. The basic purpose of the vessel 30 is to provide an amphibious support ship which can be constructed to carry out a variety of missions without having to be modified. To accomplish this purpose, as is depicted in the drawings all of the operational structural features can be arranged in the multi-purpose amphibious support vessel independently of each other thereby providing a versatile vessel. Each feature can be incorporated, eliminated or modified at will with a minimum of difficulty and expense.

The multi-purpose amphibious support vessel (MPA) provides for a series of options which can be incorporated into the final design of the MPA ship. The options selected predetermine the range of missions which the MPA can perform without requiring any post-construction modifications. In addition to military missions, the MPA can perform commercial missions such as roll-on/roll-off (RO/RO) vehicle carrier, container carrier, and brake bulk in open top containers. The basic MPA configuration arranges the optional operational structures so that any of the structures, including all of the operational structures can function without interfering with each other.

Referring to FIGS. 1*a*–1*c,* the lines drawings of the hull 20 are illustrated. Hull 20 makes extensive use of flat plate sides 22 and flat plate bottom sections 23 to minimize cost. Hull 20 will have the particulars as listed below in Table 1. These particulars are considered exemplary for a ship supporting 500 troops. For Example, if electric power is to be exported to the shore, then an electric propulsion system would be used instead of the geared diesel propulsion system shown. The engine room will be unmanned and designed to the requirements of an owner selected classification society such as the American Bureau of Shipping (ABS).

The detailed description provided below of the multi-purpose amphibious support vessel reflects the operating environment of each of the optional operational structures to be potentially included on the vessel and is not meant to be a full description of each of the structures of the vessel each of which is well known to those of ordinary skill in this art.

TABLE 1

General Characteristics

| GENERAL CHARACTERISTICS | ENGLISH | METRIC |
|---|---|---|
| Length: Overall (LOA) | 492.15 feet | 150 meters |
| Length: Design Waterline (LDWL) | 475.75 feet | 145 meters |
| Maximum Beam (B-Max) | 82.03 feet | 25 meters |
| Beam on Design Waterline (BDWL) | 79.93 feet | 24.36 meters |
| Draft at Design Waterline | 18.50 feet | 5.64 meters |
| Displacement: Full Load | 12,466 tons | 13,000 tonnes |
| Range | 8,000 n mile | 14,824 km |
| $C_b$: Block Coefficient | 0.62 | |
| V: Speed | 20 knots | 37 km/hr |
| Power: Total: Propulsion Power Twin Diesel Engines | 23,500 bhp | |
| Medium Speed Diesel Engines | 2 each | |
| Rating | 11,750 bhp | 6,756 kw |
| Engine Speed | 510 rpm | |

TABLE 1-continued

General Characteristics

| GENERAL CHARACTERISTICS | ENGLISH | METRIC |
|---|---|---|
| Propellers: Diameter (Target) | 12.5 feet | 3.05 m |
| Propellers: Speed (Target) | 120 rpm | |
| Stowage: Fuel Oil | 1,011 tons | 1,400 tonnes |
| Manning: Minimum Operating Crew | 15–20 men | |
| Manning: Naval Mission Crew | 60 men | |
| Embarked Troops | 500 men (max) | |

TABLE 2

Payload Data

| DECK NAME | AREA sq m | HEAD ROOM m | VOLUME cu m |
|---|---|---|---|
| Well Deck w/o Stern Ramp | 836 | 8.84 | 7,390 |
| Beach Deck | 673 | 4.57 | 3,079 |
| Stern Ramp | 139 | 8.08 | 1,125 |
| Forward Tunnel | 74 | 4.56 | 340 |
| TOTAL: Vehicle Decks | 1,723 | — | 11,934 |
| "C" Deck (Pallets) | 534 | 3.05 | 1,628 |
| "D" Deck (Pallets) | 427 | 3.05 | 1,302 |
| TOTAL: Pallet Decks | 961 | — | 2,930 |
| TOTAL: All Cargo Decks | 2,685 | — | 14,864 |
| Main Deck: Hangar | 217 | 10.36 | 2,249 |
| Flight Deck | 1,371 | — | — |

NOTE: Abbreviations Used:
m = meter
km = kilometer
hr = hour
kw = kilowatt
sq = square
n mi = nautical mile
knots = nautical miles per hour
bhp = brake horsepower
rpm = revolutions per minute
cu = cubic Referring now to FIGS. 2*a* and 2*b,* a multi-purpose amphibious support vessel is generally indicated at 30. The vessel 30 includes a standardized hull 20 meaning that no optional features have been added to the hull 20 but the hull 20 includes decks, operating spaces and the like. Vessel 30 includes hull 20, a main deck 32, an "A" flat level 34 below the main deck 32, a "B" deck 36 which is the beach deck 36 forward and the "B" flat 36 aft with both being below the "A" deck 34, a "C" deck 38 positioned in the forward portion of the ship and a "D" deck 40 positioned directly below the "C" deck 38 and coextensive therewith. A well deck 42 is positioned in the aft portion of the vessel 30 and a sea water ballast tank (SWB) No. 2 indicated at 44, a sea water ballast tank (SWB) No. 3 indicated at 46, and a sea water ballast tank (SWB) No. 4 indicated at 48 are positioned directly below well deck 42. Well deck 42 has a fixed ramp to the beach deck portion of "B" deck 36. A steering gear room 50 and a transverse drain well 51 are positioned near the stern directly aft of SWB No. 4 indicated at 48.

A stern ramp/gate generally indicated at 60 is located at the stern of the ship. Stern ramp/gate 60 has a lower ramp section 62 and an upper ramp section 64 as depicted in FIG. 2*b*. Lower ramp 62 is hinged at lower hinge 63 to ship 30. Lower ramp 62 is hinged at upper hinge 65 to ship 30. Hull 30 has a lower opening 66 and an upper opening 68 at the stern thereof respectively covered and closed with ramps 62,64. In the wet well position, both lower portion 62 and upper portion 64 are disengaged from hull 30. In the dry well position, lower portion 62 is engaged with opening 66 and upper portion 64 is hinged away from hull 30. An observation and traffic control room 80 is located at the aft end of the "B" flat portion of the "B" deck 36 on each side of the ship 30.

An engine room 90 is located aft of "C" deck 38 and "D" deck 40 and forward of SWB No. 2 indicated at 44. Twin propellers 92 are driven by twin shafts 94 which are in turn driven by suitable prime mover/gear sets located in the engine room 90 in a conventional manner.

A container compartment 100 holds up to 102 conventional or modular containers 103. entirety. The type of container used will determine, to some extent, the ship mission. For example, by varying the type and mix of containers, the containers compartment can be used to transport cargo, house 500 troops, used as a prison or carried empty with the ship's payload being loaded elsewhere in the ship.

A deckhouse 102 is located forward of the container compartment 100. Deckhouse 102 has a main deck level 104, an 01 level 106, an 02 level 108, an 03 level 110, an 04 level 112, an 05 level 114 and a 06 (top) level 116.

A hangar 120 is located on the main deck 32 over the engine room 90 and aft of the container compartment 100. A helicopter control station 122 is located aft of hangar 120 on the port side.

Two sideport openings 130, one on each side of the ship 30, are located between the main deck 32 and the beach deck portion of the "B" deck 36. Side port openings 128 and corresponding ramps are provided to accommodate RO/RO and/or container stowage on the beach deck 36 and the well deck 42. Side port opening 128 is depicted in FIG. 2*a* in its closed position.

In the bow portion of the ship, a retractable double hinged bow ramp 130 is depicted in FIG. 2*b* with its clam shell doors 138 depicted in FIG. 2*a*. In FIG. 2*b* the retractable double hinged bow ramp 130 is shown by dashed lines in a deployed position and solid lines in its stowed position. The outline of the clamshell door 138 in the closed position is depicted in FIG. 2*a*. The retractable double hinged bow ramp 130 includes a first portion 132 attached to the hull at its inner end by inner hinge 133 and, at its outer end, to its second portion 136 by outer hinge 134. An angled surface formed by the top of the forepeak tank provides a positive stop 139 at the maximum angle of rotation of the first portion 132. The second portion 136 has an angled area 140 at its outer end which becomes tangent to the ship's baseline plane when the first portion 132 rests on the positive stop 139. With the ship trimmed to a slight bow-up condition and the bow gently grounded, the bow ramp 130 can be rotated so that its outer end can rest on any ground bottom slope and provide through-the-bow RO/RO capabilities throughout a limited range of ground bottom slopes. The bow ramp 130 can also be mated with a pier or floating devices such as causeways, boats, and barges.

The aft pallet elevators 150 as shown in FIG. 3*b,* showing a plan view of the well deck 42, serve the main (helicopter) deck 32 and the well deck 42 with an intermediate platform 151 to serve floating boats in a wet well operation. A cargo/helicopter elevator 124 is depicted in FIG. 3*b*. Forward pallet elevators 160 are depicted in FIGS. 3*b*–3*d* and serve beach deck 36, "C" deck 38 and "D" deck 40.

Referring to FIG. 4*a,* a plan view of the main deck. A helicopter hangar 120 is depicted together with a pedestal crane 121 which serves the hangar 120 and operates over the side of the ship 30. Inside the hangar 120, a cargo/helicopter elevator 124 is depicted. The elevator 124 serves the main/hangar deck 32, the beach deck 36 and the well deck 42. In FIGS. 4*a* and 4*b* the container compartment 100 is depicted directly forward of the helicopter hangar 120. FIG. 4*a* depicts the container compartment 100 at the main deck level with three rows of containers 103 in a seven abreast arrangement with outboard weather walkways 105. FIG. 4*b* depicts the container compartment 100 at the 01, 02, & 03 levels with three rows of containers 103 in a nine abreast arrangement.

FIGS. 5*a*–5*f* depict preferred layouts for main deck and 01, 02, 03, 04, and 05 levels for the deckhouse 102. Deckhouse 102, as depicted, houses and accommodates sixty three persons as shown.

In addition to the container compartment 100 which will hold 102 forty foot equivalent (FEU) containers and as depicted on FIGS. 6*a* and 6*b*, 45 FEU containers may be carried on the well deck 42 and an additional 40 FEU's on the beach deck 36. Referring to FIGS. 6*a*, 6*b*, and 6*c* either forty foot equivalent units (FEU) containers or twenty foot equivalent units (TEU) can be loaded or unloaded through the side port doors 128 using the overhead transverse jib boom crane system 211. Transverse jib crane 211 deposits the containers in line with the various overhead container handling carriages 200 which position the containers in fore and aft lanes. The overhead container handling carriages 200 are suspended below the main deck 32 and move modular containers 103 in the fore and aft direction over the length of the beach 36 and well 42 decks. Rails for the port two carriages 200 run on the underside of the elevator platform 124. The movement of overhead container handling carriages 200 must be sequenced so that overhead container handling carriages 200 do not interfere with the movement of cargo/helicopter elevator 124.

FIG. 6*b* depicts the overhead container handling carriages 200. FIG. 6*b* is a cross-section view through the well deck 42 showing the overhead container handling carriages 200 which are suspended below the main/flight deck 32 and move modular containers 103 in the fore and aft direction.

An external rolling container crane 210 is depicted in FIG. 6*c*. Exterior rolling container crane 210 has transverse telescoping jib arms 213 to transfer containers to and from the container compartment 100 and off-ship loading platforms, floating or fixed.

FIGS. 7*a*–7*d* depict a preferred arrangement for the containers on levels 1, 2, 3, & 4 when the container compartment 100 is used to house and support a contingent of 500 embarked troops. Other arrangements and mixes of container modules may be used for other human habitation missions. The various interconnections between the containers and details of the container structures are described in the previously referenced application which is incorporated by reference herein.

FIGS. 8*a*–8*ah* are enlarged views of the containers shown in FIGS. 7*a*–7*d*. This combination of container layouts would preferably be used to accommodate approximately 500 embarked troops. Table 3 provided below shows the correspondence between the figure numbers and the reference numbers of each of the containers. A full description is not provided herein for each of the layouts of the containers as it is believed that the views are self-explanatory.

TABLE 3

(Part 1)

| FIG. | Ref. No. | No. of Units | Type of Container |
|---|---|---|---|
| 8a | 220 | 3 | 1-Man Berthing Module; 1 1-Man Stateroom/Office (Commanding Officers) |
| 8b | 222 | 1 | 3-Man Berthing Module; 3 1-Man Staterooms (Executive Officers) |
| 8c | 224 | 2 | 6-Man Berthing Module; 2 3-Man Staterooms (Other Officers) |
| 8d | 226 | 1 | 3-Man Berthing/Recreation Module; 1 3-Man Stateroom (Other Officers) + Officer Recreation Room |
| 8e | 228 | 2 | 8-Man Berthing Module; 2 4-ManStaterooms (Senior Non-Commissioned Officers) |
| 8f | 230 | 1 | 4-Man Berthing/Recreation Module; 1 4-Man Stateroom (Senior Non-Commissioned Officers) + SNCO Recreation Room |
| 8g | 232 | 7 | 18-Man Berthing Module (Junior Non-Commissioned Officers) |
| 8h | 234 | 17 | 21-Man Berthing Module (Troops) |
| 8i | 236 | 1 | JNCO Recreation Room Module (Junior Non-Commissioned Officers) |
| 8j | 238 | 3 | Troop Recreation Room Module (Troops) |
| 8k | 240 | 1 | Officer/SNCO Laundry Module (Officers and Senior Non-Commissioned Officers) |
| 8l | 242 | 1 | JNCO Laundry/Snack Bar Module (Junior Non-Commissioned Officers/Entire Unit) |
| 8m | 244 | 1 | Troop Laundry (Troops) |
| 8n | 246 | 1 | 3-Office Module (Command Offices) |
| 8o | 249 | 2 | Command and Control Center Modules Command and Control |
| 8p | 250 | 1 | Medical Examination Room/Head/Laundry Module |

TABLE 3

(Part 2)

| FIG. | Ref. No. | No. of Units | Type of Container |
|---|---|---|---|
| 8q | 252 | 1 | Medical Intensive Care Unit/Recovery Room Module |
| 8r | 254 | 1 | Galley - Kitchen #1 Module |
| 8s | 256 | 1 | Galley - Kitchen #2 Module |
| 8t | 258 | 1 | Galley - Kitchen #3 Module |
| 8u | 260 | 1 | Galley - 50% Work Room/50% Dry Stores Room Module |
| 8v | N/A | N/A | (Not Used) |
| 8w | 262 | 2 | Galley - 100% Dry Stores Module |
| 8x | 264 | 1 | Galley - 50% Thaw Room/50% Chill Room Module |
| 8y | 266 | 1 | Galley - 100% Freezer Module |
| 8z | 268 | 2 | Galley - 30-Seat Crew's Mess Module |
| 8aa | 270 | 1 | Galley - 12-Seat Officer's Mess/12-Seat SNCO'S Mess Module |
| 8ab | 272 | 1 | Scullery/Trash Compactor Module |
| 8ac | 274 | 1 | 75% Supply Issue Room/25% General Stores Module |
| 8ad | 276 | 2 | 100% General Stores Module |
| 8ae | 278 | 1 | Seabag and Pack Stowage Module |
| 8af | 280 | 1 | Diesel Generator Module |
| 8ag | 282 | 1 | Desalination/Potable Water Day Tank Module |
| 8ah | 284 | 1 | Black Water & Gray Water Sewage Treatment Module |
| 8ai | 286 | 32 | Access (Passageway and Stair Trunk) Module |
| | | 4 | Reserved and Unassigned Module Spaces |
| | | 1 | Unassigned Module Space |

It will be readily seen by one of ordinary skill in the art that the present invention fulfills all the objects set forth above. After reading the foregoing specification, one of ordinary skill will be able to effect various changes, substitutions of equivalents and various other aspects of the invention as broadly disclosed herein. It is, therefore, intended that the protection granted hereon be limited only by the definition contained in the appended claims and equivalents thereof.

What is claimed is:

1. A vessel comprising:

a hull including a cavity for receiving a plurality of containers; and wherein said hull is capable of having each of the following structures mounted on the hull without having to modify the hull:

(a) a bow ramp with clamshell doors;
(b) sideport doors and ramps;
(c) internal overhead container handling system with transverse jib booms;
(d) container compartment;
(e) exterior rolling container crane with job booms;
(f) forward pallet elevators;
(g) aft pallet elevators;
(h) a helicopter hangar;
(i) a cargo/helicopter elevator;
(j) a stern ramp/gate;
(k) wet/dry well deck;
(l) roll on/roll off cargo decks;
(m) a helicopter flight deck;
(n) a wet-well ballast system; and
(o) a bow-grounding ballast system.

2. The vessel of claim 1, wherein said hull is equipped with a bow ramp with clamshell doors, a stern ramp/gate, and a wet-well ballast system operable with a wet or dry well as a amphibious support vessel.

3. The vessel of claim 1, wherein said hull is equipped with a stern ramp/gate, a sideport door/ramps and a bow ramp with clamshell doors and operable with a dry well as a military or commercial roll on/roll off vessel.

4. The vessel of claim 1 wherein said vessel is operable as either a military or commercial cargo container carrier.

5. The vessel of claim 1 wherein said vessel operates as a military or commercial helicopter operations vessel.

6. The vessel of claim 1, further including a container compartment and a plurality of habitable modular containers arranged in said container compartment, wherein said vessel is operable as a troopship carrying embarked troops.

7. The vessel of claim 1, further including a container compartment and a plurality of habitable modular containers arranged in said container compartment, wherein said vessel is operable as a passenger vessel carrying commercial passengers.

8. The vessel of claim 1, further including an internal container handling system and one or more forward pallet elevators wherein said internal container handling system is movable fore and aft and said forward pallet elevators is sequentially movable relative to said container handling system.

9. The vessel of claim 1, further including a bow ramp with clamshell doors, sideport doors and ramps, an internal overhead container handling system a container compartment, an exterior rolling container crane, one or more forward pallet elevators, one or more aft pallet elevators, a helicopter hangar, a cargo/helicopter elevator, a stern ramp/gate, a wet/dry well deck, one or more roll on/roll off cargo decks, a helicopter flight deck, a wet-well ballast system, and a bow-grounding ballast system, wherein the aforementioned features are spaced apart such that each of said features are arranged not to interfere with each other.

10. The vessel of claim 1, wherein said vessel is operable as a prison.

11. The vessel of claim 1, further comprising a plurality of modular containers.

12. The vessel of claim 1, wherein said modular containers support a plurality of troops.

13. The vessel of claim 1, further including modular containers wherein some of said modular containers have an electric power supply, a potable water system, a black water system and a gray water system.

14. The vessel of claim 1, wherein said hull is capable of having all of the recited structures mounted on the hull without having to modify the hull.

15. A method of constructing a vessel comprising the steps of:

forming a hull having a cavity for receiving a plurality of containers; and inserting each of the following structures on the hull without having to modify the hull:

(a) a bow ramp with clamshell doors;
(b) sideport doors and ramps;
(c) internal overhead container handling system with transverse jib booms;
(d) container compartment;
(e) exterior rolling container crane with job booms;
(f) forward pallet elevators;
(g) aft pallet elevators;
(h) a helicopter hangar;
(i) a cargo/helicopter elevator;
(j) a stern ramp/gate;
(k) wet/dry well deck;
(l) roll on/roll off cargo decks;
(m) a helicopter flight deck;
(n) a wet-well ballast system; and
(o) a bow-grounding ballast system.

16. The method of claim 15, wherein said inserting step includes the step of choosing a bow ramp with clam shell doors and a wet well ballast system and a bow-grounding ballast system to operate as an amphibious support vessel.

17. The method of claim 15, wherein said inserting step includes the step of choosing a stern ramp/gate, a sideport door/ramps and a bow ramp with clam shell doors to operate as a military or commercial roll-on/roll-off vessel.

18. The method of claim 14, wherein said hull includes a container compartment and further including the step of storing 102 modular containers in said container compartment.

19. The method of claim 15, wherein said vessel is an amphibious support vessel.

20. The method of claim 18, wherein said modular containers can support 500 embarked troops.

21. The method of claim 14, wherein said inserting step includes choosing all of the recited structures.

* * * * *